US008022910B2

(12) United States Patent
Kim et al.

(10) Patent No.: US 8,022,910 B2
(45) Date of Patent: Sep. 20, 2011

(54) LIQUID CRYSTAL DISPLAY AND DRIVING METHOD THEREOF

(75) Inventors: Eun-kyung Kim, Cheonan-si (KR); Nam-suk Bang, Cheonan-si (KR); Hyun-suck Jeong, Seoul (KR)

(73) Assignee: Samsung Electronics Co., Ltd. (KR)

( * ) Notice: Subject to any disclaimer, the term of this patent is extended or adjusted under 35 U.S.C. 154(b) by 896 days.

(21) Appl. No.: 11/960,060

(22) Filed: Dec. 19, 2007

(65) Prior Publication Data

US 2008/0170020 A1 Jul. 17, 2008

(30) Foreign Application Priority Data

Jan. 15, 2007 (KR) ..... 10-2007-0004325

(51) Int. Cl.
*G09G 3/36* (2006.01)

(52) U.S. Cl. ..... 345/89; 345/204; 345/690; 345/94; 345/87

(58) Field of Classification Search ..... 345/204, 345/690, 87–104
See application file for complete search history.

(56) References Cited

U.S. PATENT DOCUMENTS 7,940,286 B2 * 5/2011 Pan et al. ..... 345/690
2003/0048248 A1 * 3/2003 Fukumoto et al. ..... 345/89
2003/0058235 A1 * 3/2003 Moon ..... 345/212
2006/0114205 A1 6/2006 Shen et al.
2006/0147062 A1 * 7/2006 Niwa et al. ..... 381/113
2008/0246712 A1 * 10/2008 Cavallini et al. ..... 345/89

FOREIGN PATENT DOCUMENTS

KR 1020030073390 9/2003
KR 1020050046162 5/2005

* cited by examiner

*Primary Examiner* — Bipin Shalwala
*Assistant Examiner* — Ilana Spar
(74) *Attorney, Agent, or Firm* — Cantor Colburn LLP

(57) ABSTRACT

A liquid crystal display includes a signal control unit which supplies an image signal; a voltage supply unit which outputs a first reference voltage when the image signal is not at a highest grayscale level and outputs a second reference voltage having a voltage level higher than that of the first reference voltage when the image signal is at the highest grayscale voltage level; a grayscale voltage generating unit which receives the first reference voltage or the second reference voltage and generates a plurality of positive- and negative-polarity grayscale voltages whose voltage levels sequentially decrease; and a data driving unit which receives the image signal, the plurality of positive- and negative-polarity grayscale voltages and applies an image data voltage corresponding to the image signal to a pixel.

30 Claims, 12 Drawing Sheets

LIQUID CRYSTAL DISPLAY AND DRIVING METHOD THEREOF

This application claims priority to Korean Patent Application No. 10-2007-0004325, filed on Jan. 15, 2007, and all the benefits accruing therefrom under 35 U.S.C. §119, the contents of which in its entirety are herein incorporated by reference.

BACKGROUND OF THE INVENTION

1. Field of the Invention

The present invention relates to a liquid crystal display and a driving method thereof, and in particular, a liquid crystal display and a driving method thereof having an improved display quality.

2. Description of the Related Art

In general, liquid crystal displays include a first display panel having pixel electrodes, a second display panel having a common electrode, a liquid crystal having dielectric anisotropy injected between the first display panel and the second display panel, a data driving unit which outputs data signals and a grayscale voltage generating unit which generates a plurality of grayscale voltages.

The grayscale voltage generating unit generates the plurality of grayscale voltages by dividing a reference voltage having a predetermined voltage level, and supplies the generated plurality of grayscale voltages to the data driving unit. The data driving unit either applies the plurality of grayscale voltages supplied from the grayscale voltage generating unit to a plurality of pixels, or may divide the plurality of grayscale voltages and then apply the divided grayscale voltages to the pixels.

Each grayscale voltage of the plurality of grayscale voltages is constant and a voltage difference between given grayscale levels is therefore constant as well. As a result, when a dark screen transitions to a bright screen or when a bright screen transitions to a dark screen, a luminance difference according to the voltage difference between the given grayscale levels is constant, making it difficult to increase the luminance difference. As a result, it is difficult to improve a display quality in the liquid crystal display.

BRIEF SUMMARY OF THE INVENTION

An exemplary embodiment of the present invention provides a liquid crystal display having an improved display quality.

Another exemplary embodiment of the present invention provides a method of driving a liquid crystal display which improves a display quality.

Exemplary embodiments of the present invention are not limited to those mentioned herein, and other exemplary embodiments of the present invention will be apparent to those skilled in the art through the following description.

According to an exemplary embodiment of the present invention, a liquid crystal display includes: a signal control unit which supplies an n-th image signal; a voltage supply unit which outputs a first reference voltage when the n-th image signal is not at a highest grayscale level and outputs a second reference voltage having a voltage level higher than that of the first reference voltage when the n-th image signal is at the highest voltage level; a grayscale voltage generating unit which receives the first reference voltage or the second reference voltage and generates first to n-th positive-polarity grayscale voltages having positive polarity with respect to a common voltage and first to n-th negative-polarity grayscale voltages having negative polarity with respect to the common voltage; and a data driving unit which receives the first to n-th positive-polarity grayscale voltages and the first to n-th negative-polarity grayscale voltages and applies an image data voltage corresponding to the n-th image signal to a pixel.

Voltage levels of the first to n-th positive-polarity grayscale voltages and the first to n-th negative-polarity grayscale voltages sequentially decrease.

The grayscale voltage generating unit includes an original grayscale voltage generating unit which divides the first reference voltage or the second reference voltage to generate first to n-th original positive-polarity grayscale voltages which have positive polarity with respect to the common voltage and whose voltage levels sequentially decrease, the first original positive-polarity grayscale voltage being lower than the first reference voltage or the second reference voltage and the n-th original positive-polarity grayscale voltage being higher than the common voltage. The grayscale voltage generating unit further includes a first selecting unit which selects the first reference voltage or the second reference voltage and outputs the selected reference voltage as the first positive-polarity grayscale voltage.

When the n-th image signal is at the highest grayscale level, the signal control unit supplies a first selection signal to the voltage supply unit and the grayscale voltage generating unit, the voltage supply unit is enabled by the first selection signal and outputs the second reference voltage, and the first selecting unit selects the second reference voltage in response to the first selection signal and outputs the second reference voltage as the first positive-polarity grayscale voltage.

When the n-th image signal is at the highest grayscale level the data driving unit applies the second reference voltage corresponding to the n-th image signal to the pixel.

The grayscale voltage generating unit may further include a second selecting unit which selects the n-th original positive-polarity grayscale voltage or the common voltage and outputs the selected n-th original positive-polarity grayscale voltage or the selected common voltage as the n-th positive-polarity grayscale voltage. When the n-th image signal is at the lowest grayscale level the signal control unit supplies a second selection signal. The second selecting unit selects the common voltage in response to the second selection signal and outputs the common voltage as the n-th positive-polarity grayscale voltage.

The grayscale voltage generating unit may further include an original grayscale voltage generating unit which divides the first reference voltage or the second reference voltage to generate first to n-th original negative-polarity grayscale voltages which have negative polarity with respect to the common voltage and whose voltage levels sequentially decrease, the first original negative-polarity grayscale voltage being lower than the common voltage and the n-th original negative-polarity grayscale voltage being higher than a ground voltage, and a first selecting unit which selects the n-th original negative-polarity grayscale voltage or the ground voltage and outputting the selected n-th original negative-polarity grayscale voltage or the selected ground voltage as the n-th negative-polarity grayscale voltage.

When the n-th image signal is at the highest grayscale level, the signal control unit supplies a first selection signal to the voltage supply unit and the grayscale voltage generating unit, the voltage supply unit is enabled by the first selection signal and outputs the second reference voltage, and the first selecting unit selects the ground voltage and outputs the ground voltage as the n-th negative-polarity grayscale voltage. Further, when the n-th image signal is at the highest grayscale level the data driving unit applies the ground voltage corresponding to the n-th image signal to the pixel.

The grayscale voltage generating unit may further include a second selecting unit which selects the first original negative-polarity grayscale voltage or the common voltage and outputs the selected first original negative-polarity grayscale voltage or the common voltage as the first negative-polarity grayscale voltage. When the n-th image signal is at the lowest grayscale level the signal control unit supplies a second selection signal and the second selecting unit selects the common voltage in response to the second selection signal and outputs the common voltage as the first negative-polarity grayscale voltage.

The voltage supply unit may include a boosting unit which boosts an input voltage provided from the outside and outputs the first reference voltage through a first output node when a first feedback voltage is fed back through a second output node and outputs the second reference voltage through the first output node when a second feedback voltage having a voltage level lower than that of the first feedback voltage is fed back through the second output node. The voltage supply unit may further include a feedback voltage generating unit which outputs the first feedback voltage or the second feedback voltage to the second output node, the second feedback voltage being output when the n-th image signal is at the highest grayscale level.

When the n-th image signal is at the highest grayscale level, the signal control unit supplies a selection signal.

The feedback voltage generating unit includes a first resistor connected between the first output node and the second output node, a second resistor connected between the second node and a ground, a third resistor having a first end and a second end, the first end connected to the ground and a switching unit enabled by the selection signal and which electrically connects the second end of the third resistor and the second output node.

The signal control unit may compare an (n−1)-th original image signal, an n-th original image signal and an (n+1)-th original image signal which are input for three continuous frames (n−1), n and (n+1), correct the n-th original image signal on the basis of a result of the comparison, and output the corrected n-th image signal.

The signal control unit supplies a selection signal when the (n−1)-th original image signal is at the lowest grayscale level and the n-th image signal is at the highest grayscale level and the voltage supply unit outputs the second reference voltage in response to the selection signal.

The signal control unit includes a first correcting unit which corrects the n-th original image signal when the grayscale level of the n-th original image signal is higher than the grayscale level of the (n−1)-th original image signal by a first reference value or more and outputs a corrected n-th original image signal having a grayscale level higher than the grayscale level of the n-th original image signal, and correcting the n-th original image signal when the grayscale level of the n-th original image signal is lower than the grayscale level of the (n−1)-th original image signal by a first reference value or more and outputs a corrected n-th original image signal having a grayscale level lower than the grayscale level of the n-th original image signal, a second correcting unit which corrects the corrected n-th image signal when the grayscale level of the corrected n-th image signal is lower than a second reference value and the grayscale level of the (n+1)-th original image signal is higher than a third reference value and outputs the n-th image signal having a grayscale level higher than the grayscale level of the corrected n-th image signal, and a discriminating unit which receives the (n−1)-th original image signal and the n-th image signal and outputs a selection signal.

The discriminating unit may include an AND operator.

The liquid crystal display may further include a first frame memory and a second frame memory. The first frame memory may receive and store the (n+1)-th original image signal and supply the n-th original image signal to the first correcting unit and the second frame memory. The second frame memory may receive and store the n-th original image signal and supply the (n−1)-th original image signal to the first correcting unit and the discriminating unit.

According to an alternate exemplary embodiment of the present invention, a liquid crystal display includes: a signal control unit which supplies an image signal and either a first selection signal or a second selection signal, the first selection signal being supplied when the image signal is at a highest grayscale level and the second selection signal being supplied when the image signal is at a lowest grayscale level; a voltage supply unit which outputs a first reference voltage when the image signal is not at the highest grayscale level and outputs a second reference voltage having a voltage level higher than that of the first reference voltage when the first selection signal is supplied to the voltage supply unit; a grayscale voltage generating unit which receives the first reference voltage or the second reference voltage and generates first to n-th positive-polarity grayscale voltages which have positive polarity with respect to a common voltage and whose voltage levels sequentially decrease and first to n-th negative-polarity grayscale voltages which have negative polarity with respect to the common voltage and whose voltage levels sequentially decrease; and a data driving unit which receives the first to n-th positive-polarity grayscale voltages and the first to n-th negative-polarity grayscale voltages and applies an image data voltage corresponding to the n-th image signal to a pixel.

The grayscale voltage generating unit includes: an original grayscale voltage generating unit which divides the first reference voltage or the second reference voltage to generate first to n-th original positive-polarity grayscale voltages which have positive polarity with respect to the common voltage and whose voltage levels sequentially decrease and first to n-th original negative-polarity grayscale voltages which have negative polarity with respect to the common voltage and whose voltage levels sequentially decrease, the first original positive-polarity grayscale voltage being lower than the first reference voltage or the second reference voltage and the n-th original positive-polarity grayscale voltage being higher than the common voltage, and the first original negative-polarity grayscale voltage being lower than the common voltage and the n-th original negative-polarity grayscale voltage being higher than a ground voltage; a first selecting unit which selects the first reference voltage from the first reference voltage and the second reference voltage in response to the first selection signal and outputs the second reference voltage as the first positive-polarity grayscale voltage; a second selecting unit which selects the ground voltage from the n-th original negative-polarity grayscale voltage and the ground voltage in response to the first selection signal and outputting the ground voltage as the n-th negative-polarity grayscale voltage; a third selecting unit which selects the common voltage from the n-th original positive-polarity grayscale voltage and the common voltage in response to the second selection signal and outputs the common voltage as the n-th positive-polarity grayscale voltage; and a fourth selecting unit which selects the common voltage from the first original negative-polarity grayscale voltage and the common voltage in response to the second selection signal and outputs the common voltage as the first negative-polarity grayscale voltage.

The voltage supply unit includes a boosting unit which boosts an input voltage provided from the outside and outputs the first reference voltage through a first output node when a first feedback voltage is fed back through a second output node and outputs the second reference voltage through the first output node when a second feedback voltage having a voltage level lower than that of the first feedback voltage is fed back through the second output node. The voltage supply unit further includes a feedback voltage generating unit which outputs the first feedback voltage or the second feedback voltage to the second output node, the second feedback voltage being output when the first selection signal is input to the feedback voltage generating unit.

The feedback voltage generating unit includes a first resistor connected between the first output node and the second output node, a second resistor connected between the second output node and a ground, a third resistor having a first end and a second end, the first end connected to the ground and a switching unit enabled by the selection signal and which electrically connects the second end of the third resistor and the second output node.

According to yet another alternate exemplary embodiment of the present invention, a method of driving a liquid crystal display includes: supplying an n-th image signal; outputting a first reference voltage when the n-th image signal is not at a highest grayscale level and outputting a second reference voltage having a voltage level higher than that of the first reference voltage when the n-th image signal is at the highest voltage level; receiving the first reference voltage or the second reference voltage and generating first to n-th positive-polarity grayscale voltages having positive polarity with respect to a common voltage and first to n-th negative-polarity grayscale voltages having negative polarity with respect to the common voltage; and receiving the first to n-th positive-polarity grayscale voltages and the first to n-th negative-polarity grayscale voltages and applying an image data voltage corresponding to the n-th image signal to a pixel.

The voltage levels of the first to n-th positive-polarity grayscale voltages and the first to n-th negative-polarity grayscale voltages sequentially decrease.

The generating of the first to n-th positive-polarity grayscale voltages and the first to n-th negative-polarity grayscale voltages includes outputting the second reference voltage as the first positive-polarity grayscale voltage when the n-th image signal is at the highest grayscale level.

The generating of the first to n-th positive-polarity grayscale voltages and the first to n-th negative-polarity grayscale voltages further includes outputting the common voltage as the n-th positive-polarity grayscale voltage when the n-th image signal is at the lowest grayscale level.

The generating of the first to n-th positive-polarity grayscale voltages and the first to n-th negative-polarity grayscale voltages includes outputting the ground voltage as the n-th negative-polarity grayscale voltage when the n-th image signal is at the highest grayscale level.

The generating of the first to n-th positive-polarity grayscale voltages and the first to n-th negative-polarity grayscale voltages further includes outputting the common voltage as the first negative-polarity grayscale voltage when the n-th image signal has the lowest grayscale level.

The supplying of the n-th image signal includes comparing an (n−1)-th original image signal, an n-th original image signal and an (n+1)-th original image signal which are input for three continuous frames (n−1), n and (n+1), correcting the n-th original image signal on the basis of the comparison result and outputting the n-th image signal.

The supplying of the n-th image signal includes correcting the n-th original image signal when the grayscale level of the n-th original image signal is higher than the grayscale level of the (n−1)-th original image signal by a first reference value or more and outputting a corrected n-th original image signal having a grayscale level higher than the grayscale level of the n-th original image signal, and correcting the n-th original image signal when the grayscale level of the n-th original image signal is lower than the grayscale level of the (n−1)-th original image signal by a first reference value or more and outputting a corrected n-th original image signal having a grayscale level lower than the grayscale level of the n-th original image signal. The supplying of the n-th image signal further includes correcting the corrected n-th image signal when the grayscale level of the corrected n-th image signal is lower than a second reference value and the grayscale level of the (n+1)-th original image signal is higher than a third reference value and outputting the n-th image signal having a grayscale level higher than the grayscale level of the corrected n-th image signal.

The generating of the first to n-th positive-polarity grayscale voltages and the first to n-th negative-polarity grayscale voltages includes supplying the second reference voltage or a ground voltage as the first positive-polarity grayscale voltage when the (n−1)-th original image signal is at the lowest grayscale level and the n-th image signal is at the highest grayscale level.

BRIEF DESCRIPTION OF THE DRAWINGS

The above and other aspects, features and advantages of the present invention will become more apparent by describing in further detail exemplary embodiments thereof with reference to the accompanying drawings, in which.

DETAILED DESCRIPTION OF THE INVENTION

Figure 1:
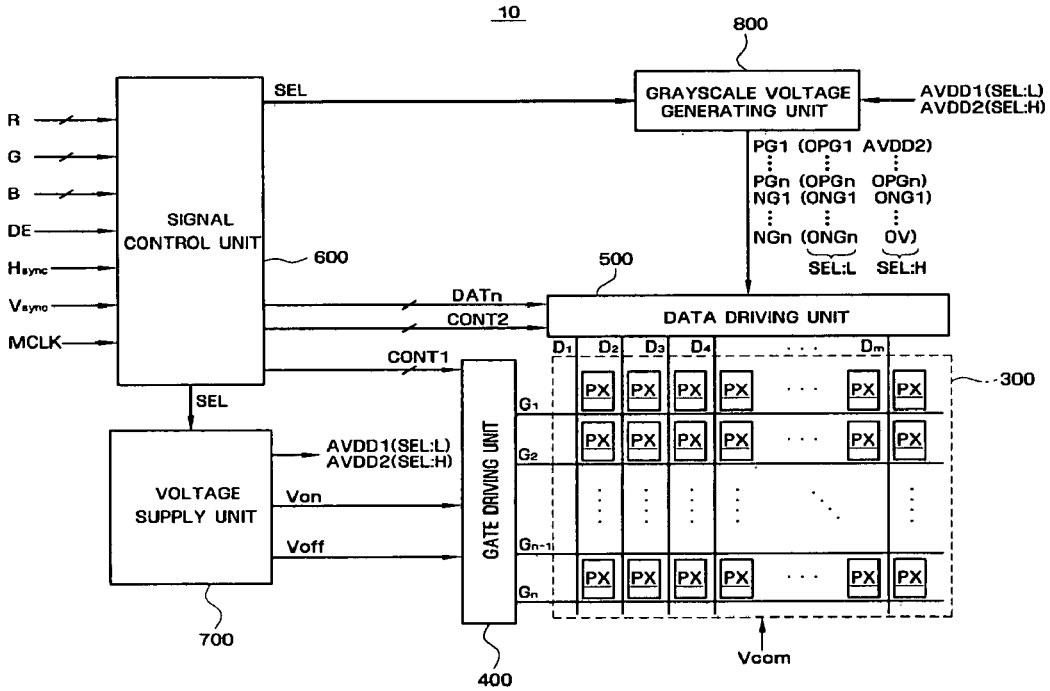
FIG. 1 is a block diagram of a liquid crystal display according to an exemplary embodiment of the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

As used herein, the term "highest grayscale level" means a grayscale level corresponding to, for example, but not being limited thereto, a full white display when a liquid crystal display is in a normally black mode. Further, the term "lowest grayscale level" means a grayscale level corresponding to, for example, but not being limited thereto, a full black display when a liquid crystal display is in a normally black mode. Hereinafter, a case in which a liquid crystal display is in a normally black mode is described in further detail.

Figure 2:
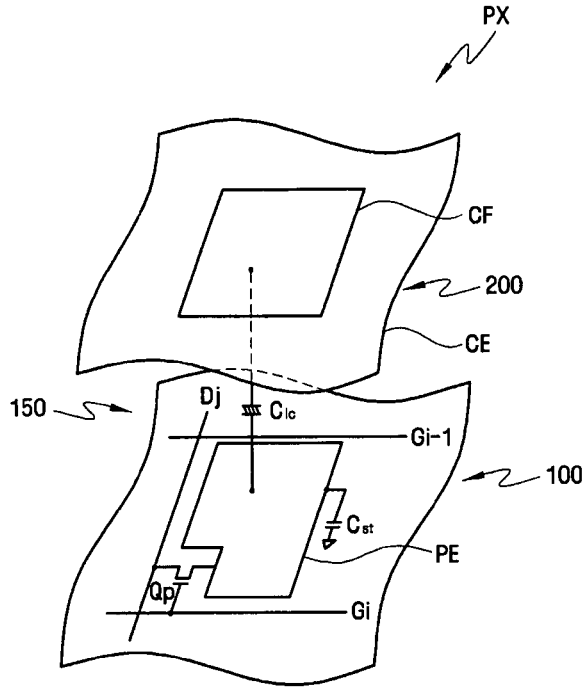
FIG. 2 is an equivalent circuit diagram of one pixel of the liquid crystal display according to an exemplary embodiment of the present invention in FIG. 1.
Figure 3:
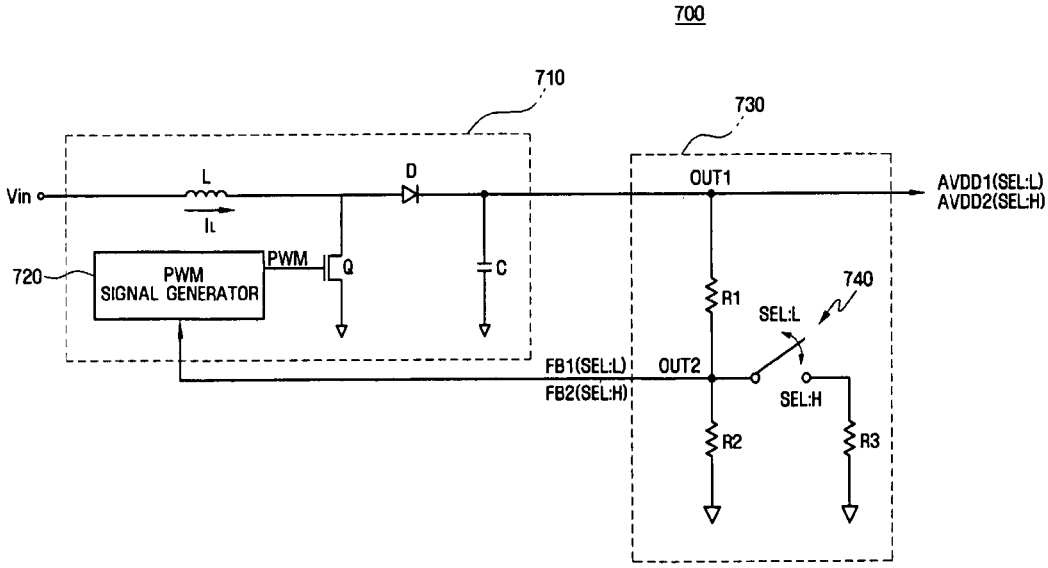
FIG. 3 is a schematic circuit diagram of a voltage supply unit of the liquid crystal display according to an exemplary embodiment of the present invention in FIG. 1.
Figure 4:
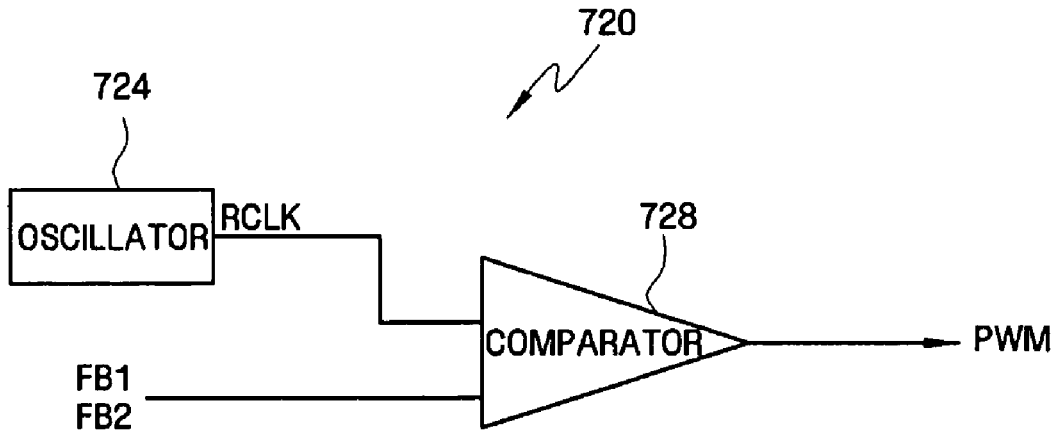
FIG. 4 is a block diagram of a pulse width modulation signal generator of the voltage supply unit according to an exemplary embodiment of the present invention in FIG. 3.
Figure 5:
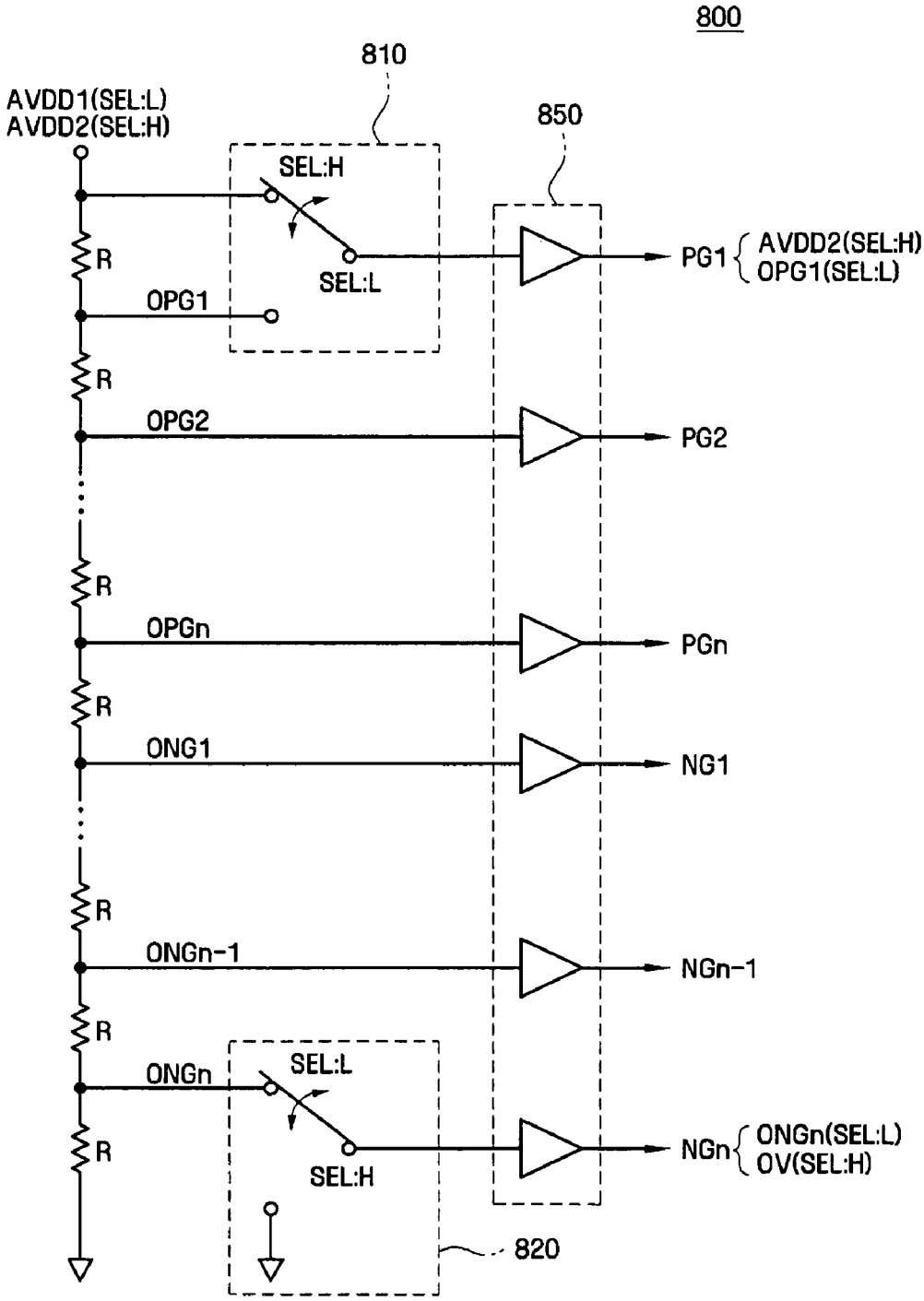
FIG. 5 is a schematic circuit diagram of a grayscale voltage generating unit of the liquid crystal display according to an exemplary embodiment of the present invention in FIG. 1.
Figure 6:
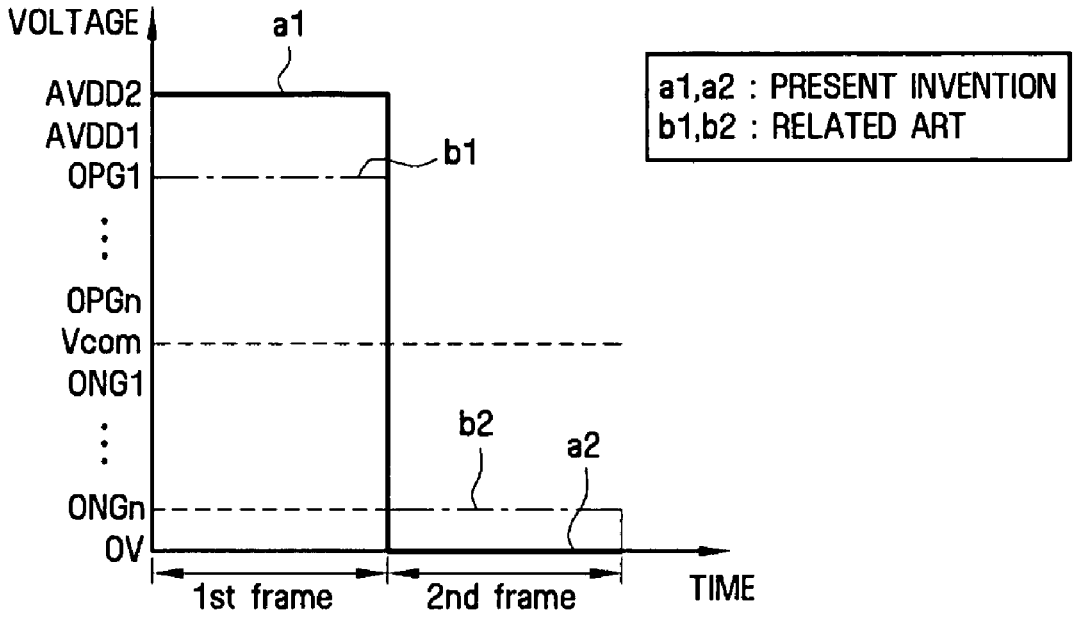
FIG. 6 is a graph of voltage versus time illustrating an operation of the grayscale voltage generating unit according to an exemplary embodiment of the present invention in FIG. 5.
Figure 7:
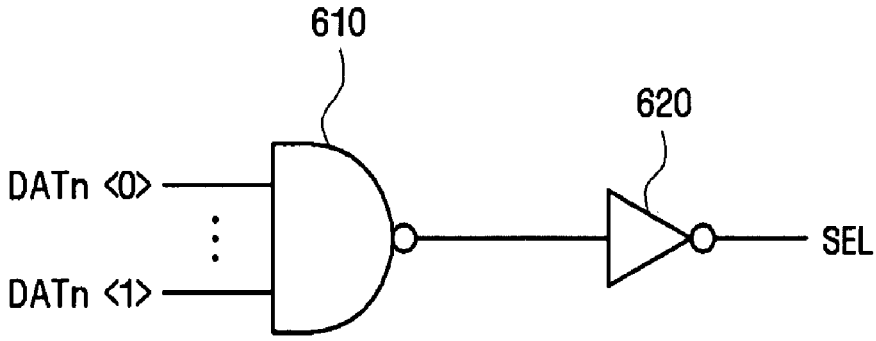
FIG. 7 is a schematic circuit diagram of a signal control unit of the liquid crystal display according to an exemplary embodiment of the present invention in FIG. 1.

A liquid crystal display according to an exemplary embodiment of the present invention and a driving method thereof will hereinafter be described in further detail with reference to FIGS. 1 to 7. FIG. 1 is a block diagram of a liquid crystal display according to an exemplary embodiment of the present invention, FIG. 2 is an equivalent circuit diagram of one pixel of the liquid crystal display according to an exemplary embodiment of the present invention in FIG. 1, FIG. 3 is a schematic circuit diagram of a voltage supply unit of the liquid crystal display according to an exemplary embodiment of the present invention in FIG. 1, FIG. 4 is a block diagram of a pulse width modulation signal generator of the voltage supply unit according to an exemplary embodiment of the present invention in FIG. 3, FIG. 5 is a schematic circuit diagram of a grayscale voltage generating unit of the liquid crystal display according to an exemplary embodiment of the present invention in FIG. 1, FIG. 6 is a graph of voltage versus time illustrating an operation of the grayscale voltage generating unit according to an exemplary embodiment of the present invention in FIG. 5, and FIG. 7 is a schematic circuit diagram of a signal control unit of the liquid crystal display according to an exemplary embodiment of the present invention in FIG. 1.

Referring to FIG. 1, a liquid crystal display 10 according to an exemplary embodiment of the present invention includes a liquid crystal panel assembly 300, a gate driving unit 400, a data driving unit 500, a signal control unit 600, a voltage supply unit 700 and a grayscale voltage generating unit 800. In the liquid crystal display 10, when an image signal DATn is at a highest grayscale level, the grayscale voltage generating unit 800 supplies a second reference voltage AVDD2 or a ground voltage (0V) to the data driving unit 500 and the data driving unit 500 applies the second reference voltage AVDD2 or the ground voltage (0V) to pixels PX in response to the image signal DATn at the highest grayscale level, thereby maximizing a luminance difference to improve display quality.

Hereinafter, functional blocks of the liquid crystal display will be described in more detail.

First, the liquid crystal panel assembly 300 includes a plurality of display signal lines $G_1$ to $G_n$ and $D_1$ to $D_m$ and a plurality of pixels PX arranged in a substantially matrix pattern as seen in FIG. 1.

The display signal lines $G_1$ to $G_n$ and $D_1$ to $D_m$ include a plurality of gate lines $G_1$ to $G_n$ which transmit gate signals and a plurality of data lines $D_1$ to $D_m$ which transmit data signals to the plurality of pixels PX. The gate lines $G_1$ to $G_n$ extend substantially in a row direction to be substantially parallel with one another, and the data lines $D_1$ to $D_m$ extend substantially in a column direction to be substantially parallel with one another, as shown in FIG. 1.

Referring to FIG. 2, one pixel PX of the liquid crystal panel assembly 300 includes a first display panel 100, a second display panel 200 facing the first display panel 100, and a liquid crystal layer 150 interposed between the first display panel 100 and the second display panel 200. A plurality of color filters CF may be formed on a portion of a common electrode CE of the second display panel 200 to face a plurality of pixel electrodes PE of the first display panel 100.

One pixel PX, for example, a pixel PX connected to an i-th gate line Gi (where, $1 \leqq i \leqq n$ and i is an integer) and a j-th data line Dj (where, $1 \leqq j \leqq m$ and j is an integer) includes a switching element Qp connected to the signal lines Gi and Dj, and a liquid crystal capacitor $C_{lc}$ and a storage capacitor $C_{st}$ connected to the switching element Qp. The storage capacitor $C_{st}$ may be omitted in alternative exemplary embodiments.

Referring back to FIG. 1, the signal control unit 600 receives signals R, G and B and various control signals for controlling display of the signals R, G and B, such as a vertical synchronization signal $V_{sync}$, a horizontal synchronization signal $H_{sync}$, a main clock MCLK and a data enable signal DE, from a graphic controller (not shown), for example, but are not limited thereto. The signal control unit 600 generates a gate control signal CONT1 and a data control signal CONT2 on the basis of the control signals, such as the vertical synchronization signal $V_{sync}$, the horizontal synchronization signal $H_{sync}$ the main clock MCLK, and the data enable signal DE, generates an image signal DATn on the basis of the signals R, G and B, and supplies the gate control signal CONT1 to the gate driving unit 400, and the data control signal CONT2 and the image signal DATn to the data driving unit 500.

The signal control unit 600 supplies a selection signal SEL to the voltage supply unit 700 and the grayscale voltage generating unit 800. More specifically, if the image signal DATn is at the highest grayscale level, the signal control unit 600 supplies the selection signal SEL at a first level, and if the image signal DATn is not at the highest grayscale level, the signal control unit 600 supplies the selection signal SEL at a second level. In an exemplary embodiment, the first level is a high level H and the second level is a low level L.

Further referring to FIG. 1, the voltage supply unit 700 supplies power required for the operation of the liquid crystal display 10. The voltage supply unit 700 generates a gate on voltage Von and a gate off voltage Voff and supplies the gate on voltage Von and the gate off voltage Voff to the gate driving unit 400. Also, the voltage supply unit 700 generates a first reference voltage AVDD1 and the second reference voltage AVDD2 for generating first to n-th positive-polarity grayscale voltages PG1 to PGn and first to n-th negative-polarity grayscale voltages NG1 to NGn, hereinafter collectively referred to as a plurality of grayscale voltages PG1 to PGn and NG1 to NGn, and supplies the first reference voltage AVDD1 and the second reference voltage AVDD2 to the grayscale voltage generating unit 800. For example, when receiving the selection signal SEL at the low level L, the voltage supply unit 700 generates the first reference voltage AVDD1 and supplies the first reference voltage AVDD1 to the grayscale voltage generating unit 800. Conversely, when receiving the selection signal SEL at the high level H, the voltage supply unit 700 generates the second reference voltage AVDD2 and supplies the second reference voltage AVDD2 to the grayscale voltage generating unit 800. In an exemplary embodiment, a voltage level of the second reference voltage AVDD2 is higher than a voltage level of the first reference voltage AVDD1. The internal circuit structure of the voltage supply unit 700 will be described in further detail later with reference to FIG. 3.

Still referring to FIG. 1, the grayscale voltage generating unit 800 receives the selection signal SEL at the low level L and divides the first reference voltage AVDD1 supplied from the voltage supply unit 700 so as to generate first to n-th original positive-polarity grayscale voltages OPG1 to OPGn and first to n-th original negative-polarity grayscale voltages ONG1 to ONGn. When the selection signal SEL at the low level L, the first to n-th original positive-polarity grayscale voltages OPG1 to OPGn and the first to n-th original negative-polarity grayscale voltages ONG1 to ONGn are output as the first to n-th positive-polarity grayscale voltages PG1 to PGn and the first to n-th negative-polarity grayscale voltages NG1 to NGn through a buffer unit (not shown).

When receiving the selection signal SEL at the high level H, the grayscale voltage generating unit 800 outputs the second reference voltage AVDD2 supplied from the voltage supply unit 700 as the first positive grayscale voltage PG1 or outputs the ground voltage (0V) as the n-th negative-polarity grayscale voltage NGn.

More specifically, when the liquid crystal display 10 is in an inversion driving mode in which the polarity of an image data voltage applied to each pixel PX is inverted on the basis of a common voltage Vcom for every frame, the grayscale voltage generating unit 800 generates the first to n-th positive-polarity grayscale voltages PG1 to PGn and the first to n-th negative-polarity grayscale voltages NG1 to NGn on the basis of the common voltage Vcom. In this case, if the image signal DATn does not have the highest grayscale level, the first original positive-polarity voltage OPG1 having a voltage level lower than the first reference voltage AVDD1 is supplied as the first positive-polarity voltage PG1, and the n-th original negative-polarity voltage ONGn having a voltage level higher than the ground voltage (0V) is supplied as the n-th negative-polarity voltage NGn.

In contrast, when the image signal DATn is at the highest grayscale level, the second reference voltage AVDD2 having the voltage level higher than the first reference voltage AVDD1 is supplied as the first positive-polarity grayscale voltage PG1, and the ground voltage is supplied as the n-th negative-polarity grayscale voltage NGn. Therefore, when the image signal DATn is at the highest grayscale level, the difference between the common voltage Vcom and the voltage applied to each pixel electrode PE (FIG. 2) is larger than when the image signal DATn is not at the highest grayscale level. Therefore, when a dark screen transitions to a bright screen, for example, the difference between the luminance of the dark screen and the luminance of the bright screen is increased, resulting in an improved display quality. The internal circuit structure and operation of the grayscale voltage generating unit 800 will be described later with reference to FIGS. 5 and 6.

Referring again to FIG. 1, the data driving unit 500 receives the data control signal CONT2 from the signal control unit 600 and operates in response to the data control signal CONT2. The data driving unit 500 selects an image data voltage corresponding to the image signal DATn from among the first to n-th positive-polarity grayscale voltages PG1 to PGn and the first to n-th negative-polarity grayscale voltages NG1 to NGn and applies the selected image data voltage to the data lines $D_1$ to $D_m$. For example, when the image signal DATn is at the highest grayscale level, the data driving unit 500 applies, as the image data voltage, the first positive-polarity grayscale voltage PG1 or the n-th negative-polarity grayscale voltage NGn to each pixel PX. More specifically, when the image signal DATn is at the highest grayscale voltage level, the data driving unit 500 applies the second reference voltage AVDD2 or the ground voltage (0V) to each pixel PX. The data control signal CONT2 is for controlling the operation of the data driving unit 500 and includes a horizontal start signal (not shown) for starting the operation of the data driving unit 500, an output instruction signal (not shown) for instructing the data driving unit 500 to output the image data voltage, for example, but is not limited thereto.

The data driving unit 500 may divide the plurality of grayscale voltages PG1 to PGn and NG1 to NGn supplied to the grayscale voltage generating unit 800. For example, when the liquid crystal display 10 displays 256 grayscale levels when the number of grayscale voltages PG1 to PGn and NG1 to NGn is smaller than 256, it is possible to divide the grayscale voltages PG1 to PGn and NG1 to NGn so as to generate 256 grayscale voltages.

The gate driving unit 400 receives the gate control signal CONT1 from the signal control unit 600 and applies a gate signal to the gate lines G1 to Gn in response to the gate control signal CONT1. Here, the gate signal includes a combination of the gate on voltage Von and the gate off voltage Voff supplied from the voltage supply unit 700. The gate control signal CONT1 is for controlling the operation of the gate driving unit 500, and may include a vertical start signal (not shown) for starting the operation of the gate driving unit 500, a gate clock signal (not shown) for determining a timing when the gate on voltage Von is output, an output enable signal (not shown) for determining the pulse width of the gate on voltage Von, for example, but is not limited thereto.

In exemplary embodiments of the present invention, the gate driving unit 400 or the data driving unit 500 may include a plurality of drive integration circuit chips and be directly mounted on the liquid crystal panel assembly 300, or may be mounted on a flexible printed circuit film (not shown) to form a tape carrier package which is attached to the liquid crystal panel assembly 300. In alternative exemplary embodiments, the gate driving unit 400 or the data driving unit 500 together with the display signal lines $G_1$ to $G_n$ and $D_1$ to $D_m$ and the switching elements Qp (FIG. 2) may be integrated on the liquid crystal display panel 300.

The voltage supply unit 700 shown in FIG. 1 will be described in further detail hereinafter with reference to FIG. 3. For convenience of explanation, discussion of the circuit for generating the gate on voltage Von and the gate off voltage Voff will be omitted.

Referring to FIG. 3, when the voltage supply unit 700 receives the selection signal SEL (FIG. 1) at the low level L, it supplies the first reference voltage AVDD1, while when the voltage supply unit 700 receives the selection signal SEL at the high level H, it supplies the second reference voltage AVDD2.

The voltage supply unit 700 may include a boosting unit 710 and a feedback voltage generating unit 730.

The boosting unit 710 outputs the first reference voltage AVDD1 or the second reference voltage AVDD2 on the basis of the voltage level of a first feedback voltage FB1 or a second feedback voltage FB2 by boosting an input voltage Vin. If the feedback voltage generating unit 730 receives the selection signal SEL at the low level L, it supplies the first feedback voltage FB1 to the boosting unit 710, and, if the feedback voltage generating unit 730 receives the selection signal SEL at the high level H, it supplies the second feedback voltage FB2 having a voltage level lower than the first feedback voltage FB1 to the boosting unit 710.

As shown in FIG. 3, the boosting unit 710 is a boost converter and includes an inductor L to which the input voltage Vin is applied, a diode D having an anode connected to the inductor L and a cathode connected to a first output node OUT1 of the feedback voltage generating unit 730, a capacitor C connected between a cathode of the diode D and a ground, and a pulse width modulation ("PWM") signal generator 720 connected to a gate of a switching element Q. A source of the switching element Q is connected to the anode of the diode D and a drain of the switching element Q is connected to the ground. In alternative exemplary embodiments of the present invention, different circuit elements and/or arrangements may be used as the boosting unit 710.

The feedback voltage generating unit 730 may include a first resistor R1, a second resistor R2, a third resistor R3, and a first selecting unit 740. The first resistor R1 is connected between the first output node OUT1 and a second output node OUT2 through which the first feedback voltage FB1 or the second feedback voltage FB2 is output. The second resistor R2 is connected between the second output node OUT2 and the ground. One end of the third resistor R3 is connected to the ground and the other end is floated, e.g., is connected to a terminal of the first selecting unit 740, as shown in FIG. 3. The first selecting unit 740 connects the other end of the third resistor R3 to the second output node OUT2 when the selection signal SEL is at the high level.

Operation of the feedback voltage generating unit 730 will now be described in further detail. It is assumed that when the selection signal SEL is at the low level L, the feedback voltage generating unit 730 uses the first resistor R1 and the second resistor R2 to divide the first reference voltage AVDD1, to generate the first feedback voltage FB1. When the image signal DATn is at the highest grayscale level, the signal control unit 600 supplies the selection signal SEL at the high level H and the first selecting unit 740 electrically connects the second output node OUT2 to the floated end of the third resistor R3. Therefore, the resistance between the second output node OUT2 and the ground decreases and thus the second feedback voltage FB2 having a voltage level lower than the first feedback voltage FB1 is output through the second output node OUT2. Here, the first selecting unit 740 may be a multiplexer ("MUX") or a switching element which is turned on or off according to the selection signal SEL, but is not limited thereto in alternative exemplary embodiments.

The operation of the boosting unit 710 will now be described in further detail. When a PWM signal PWM output from the PWM signal generator 720 is at a high level, the switching element Q is turned on. As a result, a current $I_L$ flowing through the inductor L gradually increases in proportion to the input voltage Vin applied to both ends of the inductor L on the basis of current and voltage characteristics of the inductor L.

When the PWM signal PWM is at a low level, the switching element Q is turned off such that the current $I_L$ flowing through the inductor L flows into the diode D. As a result, the capacitor C charges with a voltage according to the current and voltage characteristics of the capacitor C. Therefore, the input voltage Vin increases to a predetermined voltage. A duty ratio of the PWM signal PWM varies according to the voltage level of the first feedback voltage FB1 or the second feedback voltage FB2. When the duty ratio of the PWM signal PWM changes, the current $I_L$ flowing through the inductor L changes according to the duty ratio of the PWM signal PWM. Accordingly, a voltage potential at the first output node OUT1 changes.

Operation of the PWM signal generator 720 which outputs the PWM signal PWM whose duty ratio varies according to the voltage level of the first feedback voltage FB1 or the second feedback voltage FB2 will now be described with reference to FIG. 4. An oscillator 724 generates a reference clock signal RCLK having a predetermined frequency. A comparator 728 compares the first feedback voltage FB1 or the second feedback voltage FB2 to the reference clock signal RCLK generated by the oscillator 724. If the level of the first feedback voltage FB1 or the second feedback voltage FB2 is higher than the reference clock signal RCLK, the comparator 728 outputs the PWM signal PWM at the high level, and if the level of the first feedback voltage FB1 or the second feedback voltage FB2 is lower than the reference clock signal RCLK, the comparator 728 outputs the PWM signal PWM at the low level. In this way, the PWM signal PWM is generated. Since the frequency of the reference clock signal RCLK is constant, the duty ratio of the PWM signal PWM varies according to the level of the first feedback voltage FB1 or the second feedback voltage FB2. Therefore, when the second feedback voltage FB2 having the level lower than the first feedback voltage FB1 is supplied, the duty ratio of the PWM signal PWM becomes large. The PWM signal generator 720 is not limited to the above-mentioned structure but may be a circuit for generating the PWM signal PWM whose duty ratio varies according to the first feedback voltage FB1 or the second feedback voltage FB2.

In summary and referring back to FIG. 3, when the feedback voltage generating unit 730 supplies the first feedback voltage FB1 to the boost unit 710, the boost unit 710 outputs the first reference voltage AVDD1. In contrast, when the feedback voltage generating unit 730 supplies the second reference voltage AVDD2 having the voltage level lower than the first reference voltage AVDD1 to the boost unit 710, the duty ratio of the PWM signal PWM increases and the boost unit 710 outputs the second reference voltage AVDD2 having a voltage level higher than the first reference voltage AVDD1.

The grayscale voltage generating unit 800 shown in FIG. 1 will now be described in further detail with reference to FIGS. 5 and 6.

Referring to FIG. 5, the grayscale voltage generating unit 800 includes a plurality of resistors R, a second selecting unit 810, a third selecting unit 820 and a buffer unit 850.

The first feedback voltage FB1 or the second feedback voltage FB2 is supplied to the plurality of resistors R and the plurality of resistors R divides the supplied first feedback voltage FB1 or the supplied second feedback voltage FB2 to generate the first to n-th original positive-polarity grayscale voltages OPG1 to OPGn and the first to n-th original negative-polarity grayscale voltages ONG1 to ONGn. In one exemplary embodiment, the voltage level of the first original positive-polarity grayscale voltage OPG1 is lower than the first reference voltage AVDD1 or the second reference voltage AVDD2, the voltage level of the n-th original positive-polarity grayscale voltage OPGn is higher than the common voltage Vcom, the voltage level of the first original negative-polarity grayscale voltage ONG1 is lower than the common voltage Vcom, and the voltage level of the n-th original negative-polarity grayscale voltage ONGn is higher than the ground voltage (0V), as show in FIG. 6.

When the selection signal SEL is at the high level H, the second selecting unit 810 selects the second reference voltage AVDD2, and when the selection signal SEL is at the low level L, the second selecting unit 810 selects the first original positive-polarity grayscale voltage OPG1.

When the selection signal SEL is at the high level H, the third selecting unit 820 selects the ground voltage (0V), and when the selection signal SEL is at the low level L, the third selecting unit 820 selects the n-th original negative-polarity grayscale voltage ONGn.

The buffer unit 850 buffers either the second reference voltage AVDD2 or the first original positive-polarity grayscale voltage OPG1, the second to n-th original positive-polarity grayscale voltages OPG2 to OPGn, the first to (n−1)-th original negative-polarity grayscale voltages ONG1 to ONGn−1, and either the ground voltage (0V) or the n-th original negative-polarity grayscale voltage ONGn, and outputs the buffered voltages as the first to n-th positive-polarity grayscale voltages PG1 to PGn and the first to n-th negative-polarity grayscale voltages NG1 to NGn. The buffer unit 850 maintains the voltage levels of the second to n-th original positive-polarity grayscale voltages OPG2 to OPGn at substantially the same voltage levels as those of the second to n-th positive-polarity grayscale voltages PG2 to PGn, and the voltage levels of the first to (n−1)-th original negative-polarity grayscale voltages ONG1 to ONGn−1 at substantially the same as those of the first to (n−1)-th negative-polarity grayscale voltages NG1 to NGn−1.

FIG. 6 is a graph of voltage versus time illustrating an operation of the grayscale voltage generating unit according to an exemplary embodiment of the present invention in FIG. 5. More specifically, FIG. 6 illustrates levels of the image data voltage applied to each pixel PX when the liquid crystal display 10 according to an exemplary embodiment is in the inversion drive mode and the image signal DATn is at the highest grayscale level for two continuous frames.

According to the related art, when the image signal DATn is at the highest grayscale level in the first frame of the two continuous frames, the first original positive-polarity grayscale voltage OPG1 having the voltage level lower than the first reference voltage AVDD1 is applied to each pixel PX (level b1 in FIG. 6). However, according to an exemplary embodiment of the present invention, when the image signal DATn is at the highest grayscale level in the first frame, the second reference voltage AVDD2 is applied to each pixel PX (level a1 in FIG. 6). Further, according to the related art, in the second frame the n-th original negative-polarity grayscale voltage ONGn having the voltage level higher than the ground voltage (0V) is applied to each pixel PX (level b2 in FIG. 6). However, according to an exemplary embodiment of the present invention, in the second frame the ground voltage (0V) is applied to each pixel PX (level a2 in FIG. 6).

Therefore, according to an exemplary embodiment of the present invention (levels a1 and a2), since the difference between the common voltage and the voltage applied to the pixel electrode increases as compared to the related art (levels b1 and b2), when a dark screen transitions to a bright screen, a difference between a luminance of the dark screen and a luminance of the bright screen is increased, and a display quality is thereby improved.

FIG. 7 is a schematic circuit diagram of a signal control unit of the liquid crystal display according to an exemplary embodiment of the present invention in FIG. 1 for generating the selection signal SEL. In an exemplary embodiment, a circuit for generating the selection signal SEL may include a NAND operator 610 and an inverter 620 which function as one AND operator. For example, when the image signal DATn is an 8-bit signal, the NAND operator 610 receives individual bit data DAT<0> to DAT<7> through 8 input terminals. When the image signal DATn is at the highest grayscale level and the bit data of the image signal DATn is 11111111, the selection signal SEL is at the high level H, while when the image signal DATn is not at the highest grayscale levels, the selection signal SEL is at the low level L. The circuit for generating the selection signal SEL is not limited to the above-mentioned structure and may be variously modified in alternative exemplary embodiments of the present invention. Further, the circuit for generating the selection signal SEL may be provided inside the signal control unit 600, as shown in FIG. 1, or may be provided outside the signal control unit 600 in alternative exemplary embodiments of the present invention.

Figure 8:
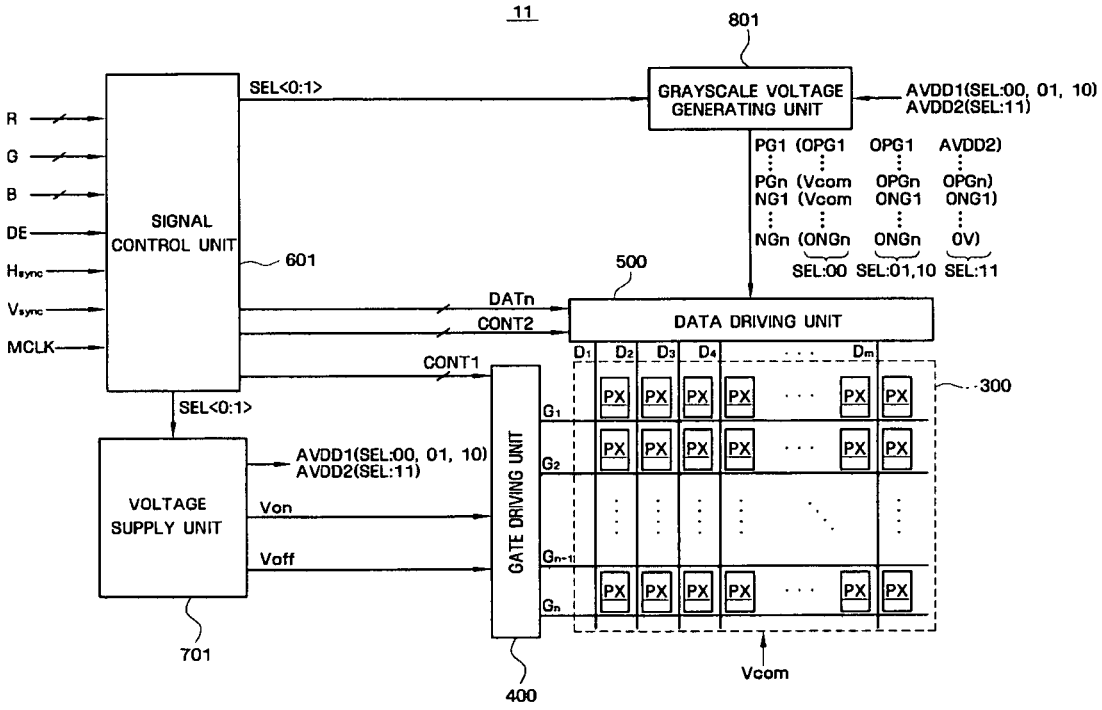
FIG. 8 is a block diagram of a liquid crystal display according to an alternative exemplary embodiment of the present invention.
Figure 9:
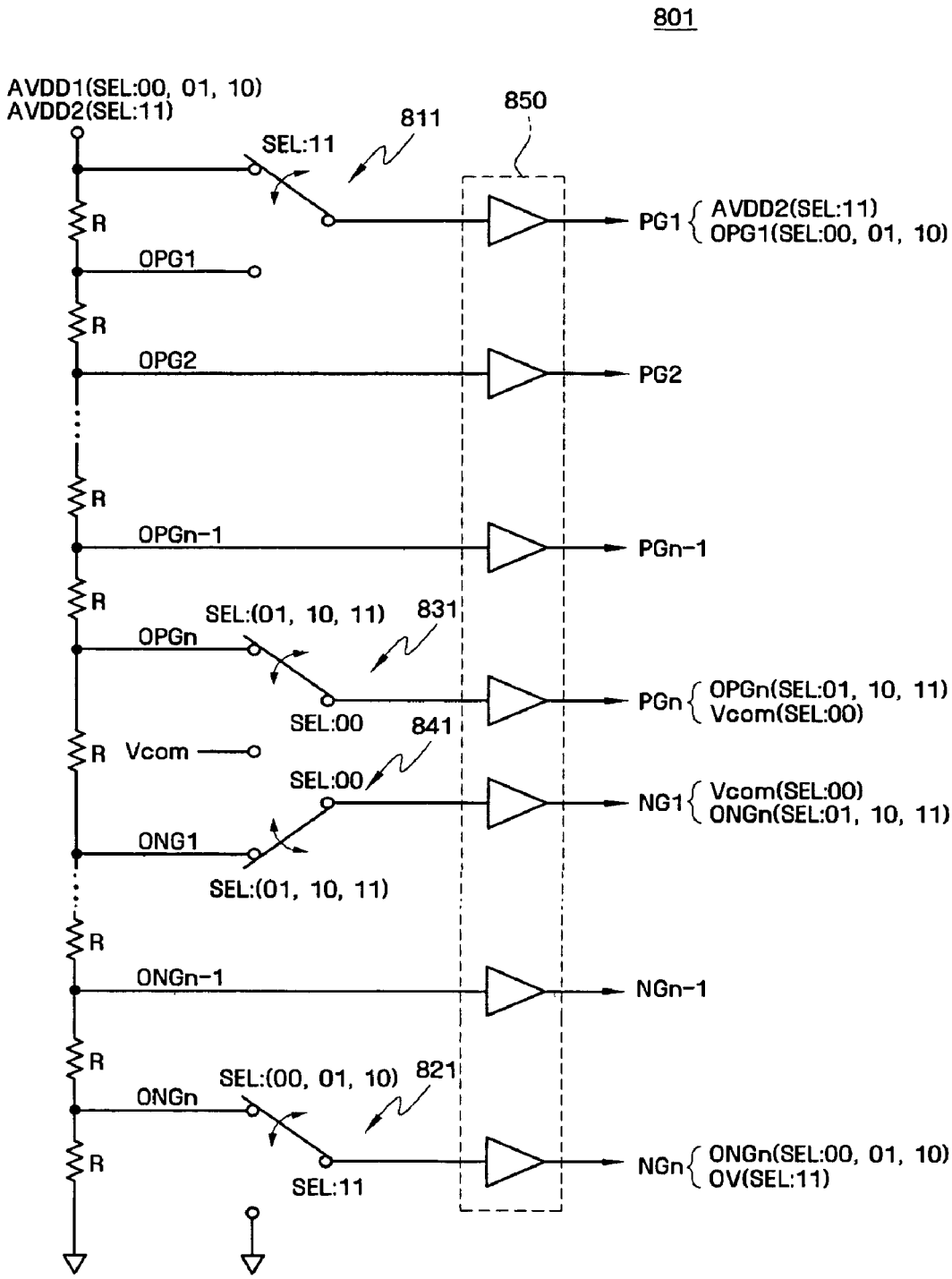
FIG. 9 is a schematic circuit diagram of a grayscale voltage generating unit of the liquid crystal display according to an alternative exemplary embodiment of the present invention in FIG. 8.
Figure 10:
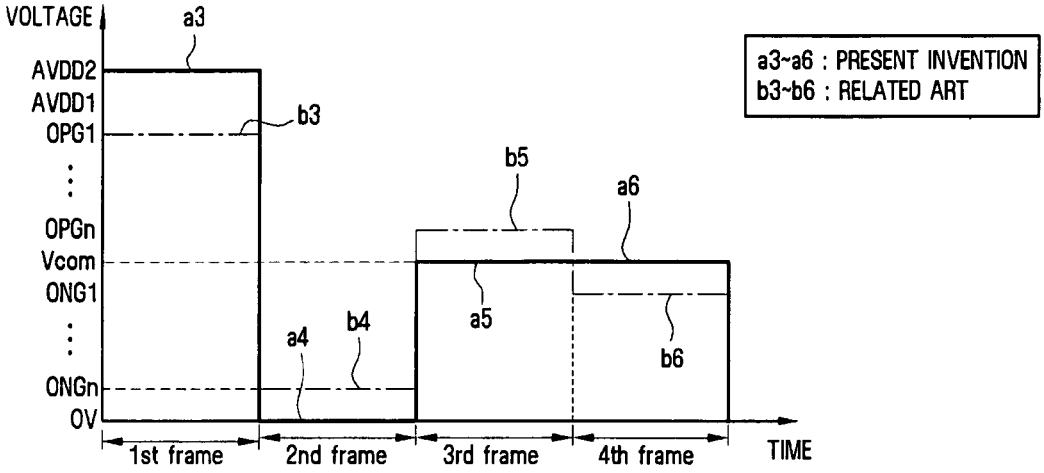
FIG. 10 is a graph of voltage versus time illustrating an operation of the grayscale voltage generating unit according to an alternative exemplary embodiment of the present invention in FIG. 9.
Figure 11:
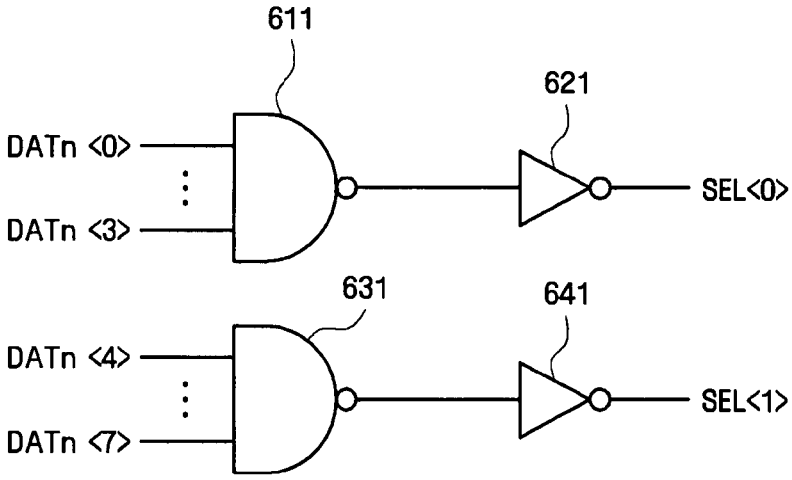
FIG. 11 is a schematic circuit diagram of a signal control unit of the liquid crystal display according to an alternative exemplary embodiment of the present invention in FIG. 8.

Hereinafter, a liquid crystal display according to an alternative exemplary embodiment of the present invention will be described in further detail with reference to FIGS. 8 to 11. FIG. 8 is a block diagram of a liquid crystal display according to an alternative exemplary embodiment of the present invention, FIG. 9 is a schematic circuit diagram of a grayscale voltage generating unit of the liquid crystal display according to an alternative exemplary embodiment of the present invention in FIG. 8, FIG. 10 is a graph of voltage versus time illustrating an operation of the grayscale voltage generating unit according to an alternative exemplary embodiment of the present invention in FIG. 9, and FIG. 11 is a schematic circuit diagram of a signal control unit of the liquid crystal display according to an alternative exemplary embodiment of the present invention in FIG. 8. Throughout FIGS. 8 to 11, components having the same functions as components shown in FIG. 1 are denoted by the same reference numerals. Further, for convenience of explanation, a detailed description of those components is omitted hereinafter.

The exemplary embodiment of a liquid crystal display 11 described hereinafter with reference to FIGS. 8 to 11 is different from the exemplary embodiment of the liquid crystal display 10 described in reference to FIGS. 1 to 7 in that when the image signal DATn is at the lowest grayscale level, a grayscale voltage generating unit 801 outputs the common voltage Vcom as the n-th positive-polarity grayscale voltage PGn and the first negative-polarity grayscale voltage NG1. The selection signal SEL may be a 2-bit signal. Thus, when the image signal DATn is at the highest grayscale level, the selection signal SEL is, for example, 11, but is not limited thereto, and the second reference voltage AVDD2 is output as the first positive-polarity grayscale voltage PG1 and the ground voltage (0V) is output as the n-th negative-polarity grayscale voltage NGn, for which a voltage supply unit 701 supplies the second reference voltage AVDD2 if the selection signal SEL is 11 and the first reference voltage AVDD1 if the selection signal SEL is not 11.

The grayscale voltage generating unit 801 shown in FIG. 8 will now be described in further detail with reference to FIGS. 9 and 10.

Referring to FIG. 9, the grayscale voltage generating unit 801 includes a fourth selecting unit 831 and a fifth selecting unit 841 in addition to the structure of the grayscale voltage generating unit 800 according to the previous exemplary embodiment (FIG. 5).

The second selecting unit 811 selects the second reference voltage AVDD2 when the selection signal SEL supplied to the second selecting unit 811 is 11, otherwise the second selecting unit 811 selects the first original positive-polarity grayscale voltage OPG1. The third selecting unit 821 selects the ground voltage (0V) when the selection signal SEL supplied to the third selecting unit 821 is 11, otherwise the third selecting unit 821 selects the n-th original negative-polarity grayscale voltage ONGn. The fourth selecting unit 831 selects the common voltage Vcom if the selection signal SEL supplied to the fourth selection signal SEL is 00, otherwise the fourth selecting unit 831 selects the n-th original positive-polarity grayscale voltage OPGn. The fifth selecting unit 841 selects the common voltage Vcom if the selection signal SEL supplied to the fifth selecting unit 841 is 00, otherwise the fifth selecting unit 841 selects the first original negative-polarity grayscale voltage ONG1. Each of the second to fifth selecting units 811, 821, 831 and 841 may be an MUX or a switching element which is switched in response to a 2-bit signal, for example, but is not limited thereto.

FIG. 10 is a graph of voltage versus time illustrating an operation of the grayscale voltage generating unit according to an alternative exemplary embodiment of the present invention in FIG. 9. More specifically, FIG. 10 is a graph illustrating levels of the image data voltage applied to each pixel PX when the liquid crystal display 11 is in an inversion drive mode for four continuous frames and the image signal DATn is at the highest grayscale level for a first two continuous frames and is then at the lowest grayscale level for a subsequent next two continuous frames.

According to the related art, in the first frame of the four continuous frames, the first original positive-polarity grayscale voltage OPG1 having the voltage level lower than the first reference voltage AVDD1 is applied to each pixel PX (level b3 in FIG. 10). However, according to this alternative exemplary embodiment, in the first frame, the second reference voltage AVDD2 is applied to each pixel PX (level a3 in FIG. 10). Further, according to the related art, in the second frame, the n-th original negative-polarity grayscale voltage ONGn having the voltage level higher than the ground voltage (0V) is applied to each pixel PX (level b4 in FIG. 10). However, according to this alternative exemplary embodiment, in the second frame, the ground voltage (0V) is applied to each pixel PX (level a4 in FIG. 10).

According to the related art, in the third frame, the n-th original positive-polarity grayscale voltage OPGn having the voltage level higher than the common voltage Vcom is applied to each pixel PX (level b5 in FIG. 10). However, according to this alternative exemplary embodiment, in the third frame, the common voltage Vcom is applied to each pixel (level a5 in FIG. 10). Finally, according to the prior art, in the fourth frame, the first original negative-polarity grayscale voltage ONG1 having the voltage level lower than the common voltage Vcom is applied to each pixel PX (level b6 in FIG. 10). However, according to this alternative exemplary embodiment, in the fourth frame, the common voltage Vcom is applied to each pixel PX (level a6 in FIG. 10).

Therefore, according to an alternative exemplary embodiment of the present invention, a difference between the common voltage and the voltage applied to the pixel electrode (a3 and a4) when the image signal DATn is at the highest grayscale level increases compared to in the related art (b3 and b4). Therefore, when a dark screen transitions to a bright screen, the difference between a luminance of the dark screen and a luminance of the bright screen is increased. Further, according to an alternative exemplary embodiment of the invention, a difference between the common voltage and the voltage applied to the pixel electrode (a5 and a6) when the image signal DATn is at the lowest grayscale level decreases compared to in the related art (b5 and b6). Therefore, when the bright screen transitions to the dark screen, the difference between the luminance of the bright screen and the luminance of the dark screen is further maximized, and thus display quality is further improved.

FIG. 11 is a schematic circuit diagram of a signal control unit of the liquid crystal display according to an alternative exemplary embodiment of the present invention in FIG. 8. More specifically, FIG. 11 illustrates an example of a circuit for generating the 2-bit selection signal SEL. A circuit for generating the 2-bit selection signal SEL may include two NAND operators 611 and 631 and two inverters 621 and 641. In this circuit, the NAND operators 611 and 631 are paired with the inverters 621 and 641, respectively, and each of the pairs functions as one AND operator. Thus, when the image signal DATn is an 8-bit signal, for example, but is not limited thereto, the NAND operators 611 and 631 each having four input terminals receive the individual bit data DAT<0> to DAT<7> through input terminals. When the image signal DATn is at the highest grayscale levels and the bit data of the image signal DATn is 11111111, the lowest bit SEL<0> and the highest bit SEL<1> of the selection signal SEL are 1. The circuit for generating the selection signal SEL is not limited to the above-mentioned structure and may be modified in alternative exemplary embodiments. Further, the circuit for generating the selection signal SEL may be provided inside the signal control unit 600 as shown in FIG. 8 or may be provided outside the signal control unit 600.

Figure 12:
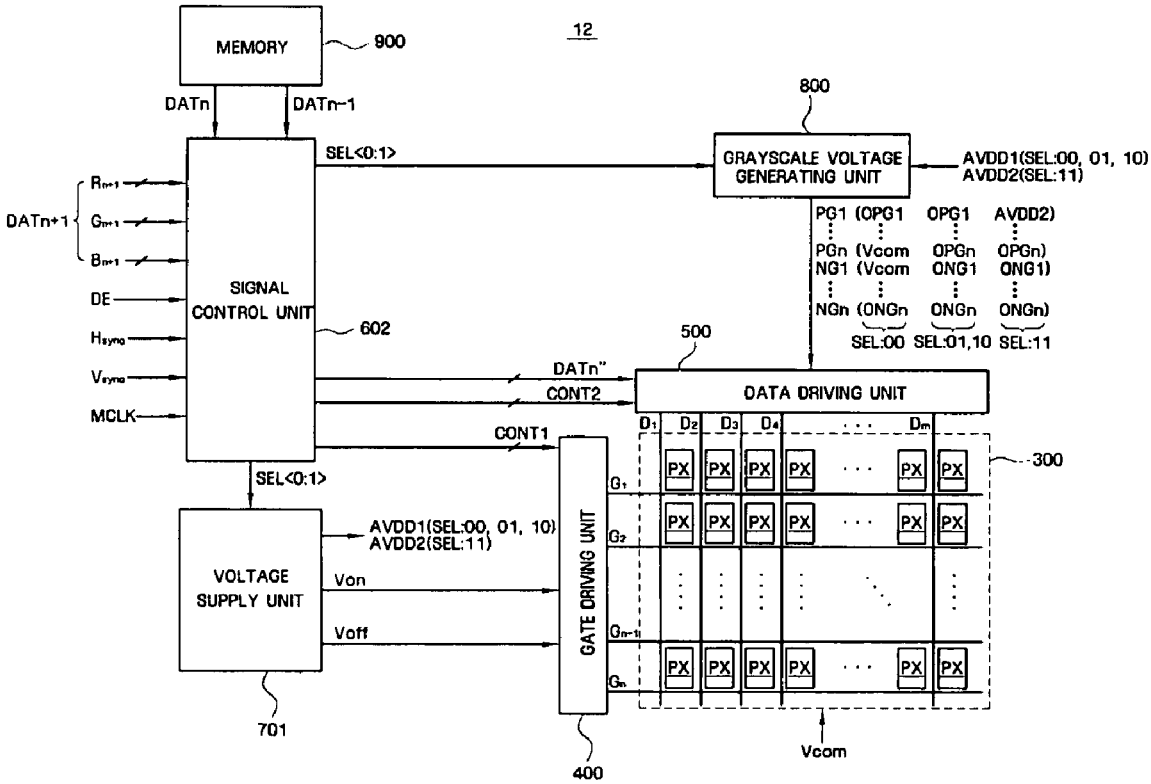
FIG. 12 is a block diagram of a liquid crystal display according to another alternative exemplary embodiment of the present invention.
Figure 13:
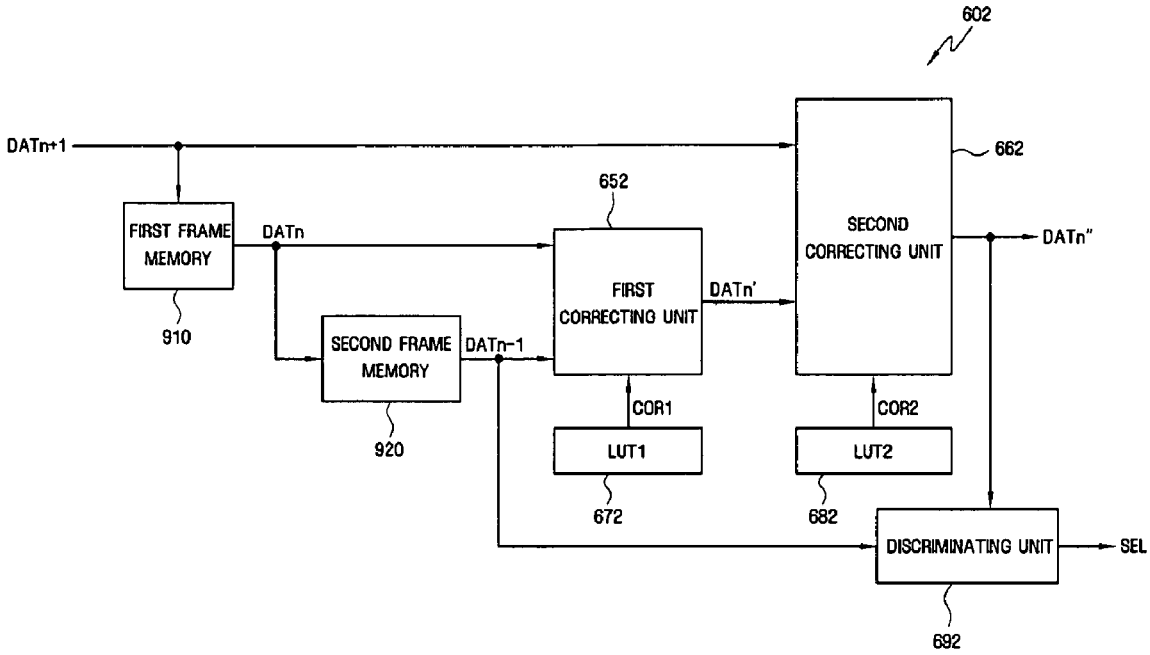
FIG. 13 is a block diagram of a signal control unit of the liquid crystal display according to another alternative exemplary embodiment of the present invention in FIG. 12.
Figure 14:
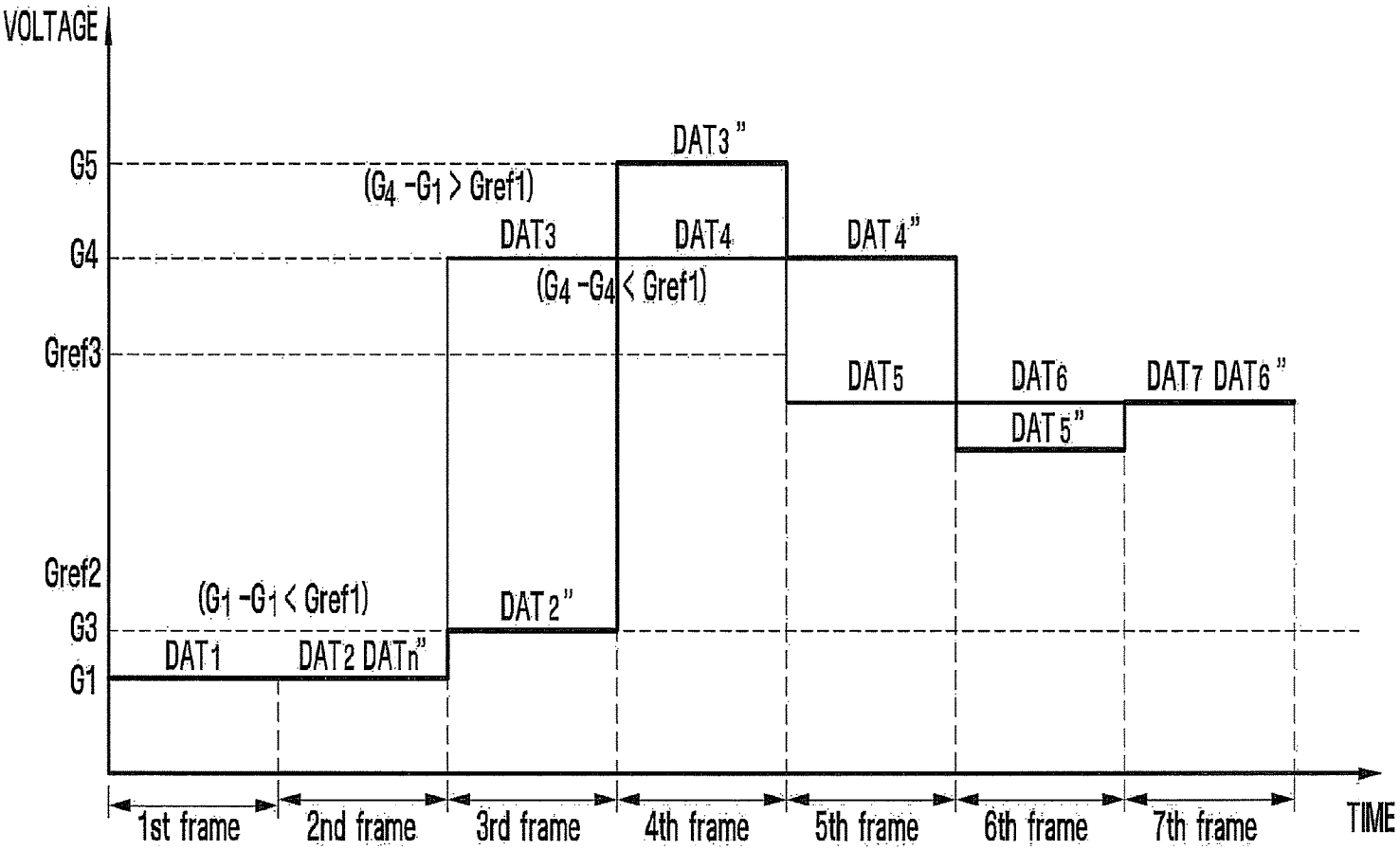
FIG. 14 is a graph of voltage versus time illustrating an operation of the signal control unit according to another alternative exemplary embodiment of the present invention in FIG. 13.
Figure 15:
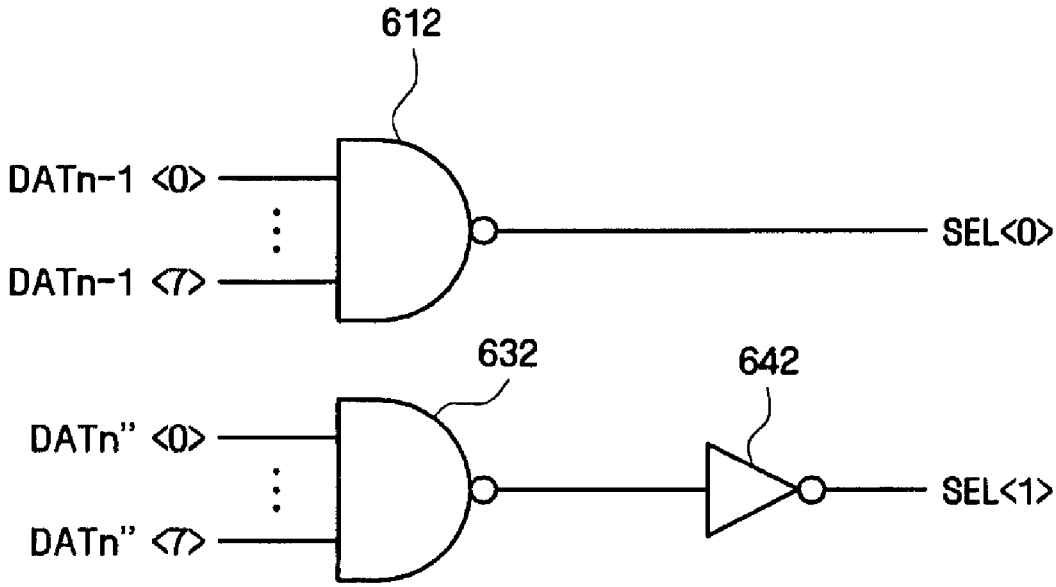
FIG. 15 is a schematic circuit diagram of a discriminating unit according to another alternative exemplary embodiment of the present invention in FIG. 13.

Hereinafter, a liquid crystal display according to yet another alternative exemplary embodiment of the present invention and a driving method thereof will be described with reference to FIGS. 12 to 15. FIG. 12 is a block diagram of a liquid crystal display according to another alternative exemplary embodiment of the present invention, FIG. 13 is a block diagram of a signal control unit of the liquid crystal display according to another alternative exemplary embodiment of the present invention in FIG. 12, FIG. 14 is a graph of voltage versus time illustrating an operation of the signal control unit according to another alternative exemplary embodiment of the present invention in FIG. 13, and FIG. 15 is a schematic circuit diagram of a discriminating unit of the signal control unit according to another alternative exemplary embodiment of the present invention shown in FIG. 13. Throughout FIGS. 12 to 15, components having the same functions as components shown in FIGS. 1 and 8 are denoted by the same reference numerals. For convenience of explanation, a detailed description of these components is omitted hereinafter. This exemplary embodiment is different from the previous exemplary embodiments in that original image signals input to the signal control unit are denoted by reference symbols DATn−1, DATn, and DATn+1 and image signals output from the signal control unit are denoted by a reference symbol DATn".

Referring to FIG. 12, a liquid crystal display 12 according to yet another alternative exemplary embodiment further includes a memory 900. Further, in yet another alternative exemplary embodiment, a signal control unit 602 receives (n−1)-th to (n+1)-th original image signals DATn−1, DATn, and DATn+1, each of which has associated signals $R_{n+1}$, $G_{n+1}$ and $B_{n+1}$, for example, but is not limited thereto, in three continuous frames (n−1), n and (n+1), corrects the n-th image signal DATn of the n-th frame, and outputs an n-th image signal DATn". The correcting operation of the signal control unit 602 may be for improving a display quality and/or a response speed of the liquid crystal display 12.

Referring to FIG. 13, the memory 900 shown in FIG. 12 includes a first frame memory 910 and a second frame memory 920, and the signal control unit 602 includes a first correcting unit 652, a second correcting unit 662, and a discriminating unit 692. Further, the liquid crystal display 12 may further include a first look-up table ("LUT1") 672 and a second look-up table ("LUT2") 682 as shown in FIG. 13.

The first frame memory 910 receives the (n+1)-th original image signal DATn+1 and supplies the n-th original image signal DATn to the first correcting unit 652. The second frame memory 920 receives the n-th original image signal DATn and supplies the (n−1)-th original image signal DATn−1 to the first correcting unit 652 and the discriminating unit 692.

The first correcting unit 652 receives the n-th original image signal DATn and the (n−1)-th original image signal DATn−1, compares them, corrects the n-th original image signal DATn, and outputs a corrected n-th original image signal DATn'. When the grayscale level of the n-th original image signal DATn is higher than the grayscale level of the (n−1)-th original image signal DATn−1 by a first reference value (not shown) or more, the first correcting unit 652 performs correction on the n-th original image signal DATn and outputs the corrected n-th original image signal DATn' having a grayscale level higher than the grayscale level of the n-th original image signal DATn. When the grayscale level of the n-th original image signal DATn is lower than the grayscale level of the (n−1)-th original image signal DATn−1 by the first reference value or more, the first correcting unit 652 performs correction on the n-th original image signal DATn and outputs the corrected n-th original image signal DATn' having a grayscale level lower than the grayscale level of the n-th original image signal DATn. When correcting the n-th original image signal DATn, the first correcting unit 652 may use a first correction signal COR1 supplied from the first look-up table 672. For example, the first correction signal COR1 may be the corrected n-th original image signal DATn', but is not limited thereto.

The second correcting unit 662 compares the corrected n-th original image signal DATn' and the (n+1)-th original image signal DATn+1 and outputs the n-th image signal DATn". When the grayscale level of the corrected n-th original image signal DATn' is equal to or less than a predetermined second reference value (not shown) and the grayscale level of the (n+1)-th original image signal DATn+1 is equal to or more than a predetermined third reference value (not shown), the second correcting unit 662 performs correction on the n-th corrected original image signal DATn', and outputs the n-th image signal DATn" having a grayscale level between the second reference value and the third reference value. When correcting the n-th original image signal DATn', the second correcting unit 662 may use a second correction signal COR2 supplied from the second look-up table 682. For example, the second correction signal COR2 may be the n-th image signal DATn", but is not limited thereto.

The discriminating unit 692 receives the (n−1)-th original image signal DATn−1 and the n-th image signal DATn" and supplies the selection signal SEL. For example, when the (n−1)-th original image signal DATn−1 is at the lowest grayscale level and the n-th image signal DATn" is at the highest grayscale level, the discriminating unit 692 may output 11 as the selection signal SEL, but is not limited thereto. When the selection signal SEL is 11, the second reference voltage AVDD2 is supplied as the first positive-polarity grayscale voltage PG1, similar to as described above in reference to other exemplary embodiments of the present invention. Therefore, when a dark screen is transitioned to a bright screen, a difference in luminance between grayscale levels is maximized and thus a display quality is improved. Further, when the selection signal SEL is 11, the response speed of the liquid crystal display 12 is improved, since a higher voltage is applied to each pixel PX.

The correction operation described above in reference to FIGS. 12 and 13 will be described in more detail with reference to FIG. 14. FIG. 14 is a graph of voltage versus time illustrating an operation of the signal control unit according to another alternative exemplary embodiment of the present invention in FIG. 13. More specifically, FIG. 14 shows the grayscale levels of the (n−1)-th to (n+1)-th original image signals DATn−1 to DATn+1 input to the signal control unit 602 and the grayscale level of the n-th image signal DATn" output from the signal control unit 602. Since the signal control unit 602 receives the (n+1)-th original image signal DATn+1 of the (n+1)-th frame and outputs the n-th image signal DATn" of the n-th frame as shown in FIG. 13, the image signal is delayed by one frame before being displayed. For convenience, the n-th original image signal DATn' shown in FIG. 13 is not shown in FIG. 14. Since the detailed description of the operation of the signal control unit 602 is disclosed in Korean Registered Patent No. 514080, in this specification only the operation of the signal control unit for first to fifth frames will be described and a description of the operation of the signal control unit for sixth and seventh frames will be omitted.

First, it is assumed that the first and second original image signals DAT1 and DAT2 input in the first and second frames are, respectively, at the lowest grayscale level and the first image signal DAT1" output in the second frame is also at the lowest grayscale level. Here, a voltage level corresponding to the lowest grayscale level may be the common voltage Vcom as described above.

The second image signal DAT2" (which corresponds to a case in which n of FIG. 13 is 2) which the signal control unit 602 outputs in the third frame will now be described, the first correcting unit 652 compares the grayscale level G1 of the first original image signal DAT1 of the first frame and the grayscale level G1 of the second original image signal DAT2 of the second frame. Since the difference between the grayscale level G1 of the first original image signal DAT1 and the grayscale level G1 of the second original image signal DAT2 is smaller than a first reference value Gref1 (e.g., G1−G1<Gref1), the second original image signal DAT2 having the lowest grayscale level G1 is supplied to the second correcting unit 662 without being changed. The second correcting unit 662 compares the grayscale level G1 of the second original image signal DAT2 and the grayscale level G4 of the third original image signal DAT3 of the third frame. In this case, since the grayscale level G1 is lower than a second reference value Gref2 and the grayscale level G4 of the third original image signal DAT3 is higher than a third reference value Gref3, the second image signal DAT2" having a grayscale level G3 higher than the lowest grayscale level G1 is output.

Next, a third image signal DAT3" (which corresponds to a case in which n of FIG. 13 is 3) which the signal control unit 602 outputs in the fourth frame will be described. The first correcting unit 652 compares the grayscale level G1 of the second original image signal DAT2 of the second frame and the grayscale level G4 of the third original image signal DAT3 of the third frame. The difference between the grayscale level G1 of the second original image signal DAT2 and the grayscale level G4 of the third original image signal DAT3 is larger than the first reference value Gref1 (e.g., G4−G1>Gref1), the first correcting unit 652 supplies a corrected original image signal having a grayscale level G5 higher than the grayscale level G4 of the third original image signal DAT3 to the second correcting unit 662. Since both of the grayscale level G5 of the corrected original image signal and the grayscale level G5 of the fourth original image signal DAT4 are larger than the third reference value Gref3, the second correcting unit 662 outputs the corrected original image signal as the third image signal DAT3" without being changed.

When the grayscale level G5 (not shown in FIG. 14) of the third image signal DAT3" is the highest grayscale level, the discriminating unit 692 outputs 11 as the selection signal SEL and thus the second reference voltage AVDD2 is applied to each pixel PX. Since the second reference voltage AVDD2, having a voltage level higher than the first reference voltage AVDD1 is applied to each pixel PX, when a dark screen transitions to a bright screen, a difference in luminance between the grayscale levels is increased and a response speed of the liquid crystal is improved, thereby improving the display quality.

Next, a fifth image signal DAT4" (which corresponds to a case in which n of FIG. 13 is 4) which the signal control unit 602 outputs in the fifth frame will be described. The first correcting unit 652 compares the grayscale level G4 of the third original image signal DAT3 of the third frame and the grayscale level G4 of the fourth original image signal DAT4 of the fourth frame. The difference between the grayscale level G4 of the third original image signal DAT3 and the grayscale level G4 of the fourth original image signal DAT4 is smaller than the first reference value Gref1 (e.g., G4−G1<Gref1), the first correcting unit 652 supplies the fourth original image signal DAT4 to the second correcting unit 662 without being changed. Since the grayscale level G4 of the fourth original image signal DAT4 is higher than the third reference value Gref3 and the grayscale level of the fifth original image signal is lower than the third reference value Gref3, the second correcting unit 662 outputs the fourth original image signal DAT4 as the fourth image signal DAT4" without being changed. Here, the first, second, and third reference values Gref1, Gref2 and Gref3 are not limited to specific values but may be varied in alternative exemplary embodiments of the present invention.

Thus, according to the liquid crystal display 12 of an exemplary embodiment, a response speed of a liquid crystal is improved and a difference in luminance between grayscale levels when the lowest grayscale level transitions to the highest grayscale level is increased, thereby improving a display quality.

FIG. 15 is a schematic circuit diagram of a discriminating unit according to an alternative exemplary embodiment of the present invention in FIG. 13 illustrating an example of the circuit for generating the selection signal SEL.

A circuit for generating the selection signal SEL may include two NAND operators 612 and 632 and an inverter 642. In the circuit, the NAND operator 632 is paired with the inverter 642 and the NAND operator 632 thereby functions as an AND operator. Therefore, when the image signal DATn is an 8-bit signal, for example, but not being limited thereto, the NAND operator 612 receives the individual bit data DATn−1<0> to DATn−1<7> of the (n−1)-th original image signal DATn−1 through 8 input terminals and the NAND operator 632 receives the individual bit data DATn"<0> to DAT"<7> of the n-th image signal DATn" through 8 input terminals. When the (n−1)-th original image signal DATn−1 is at the lowest grayscale levels, e.g., the bit data of the (n−1)-th original image signal DATn−1 is 00000000, and the n-th image signal DATn" is at the highest grayscale level, e.g., the bit data of the n-th image signal DATn" is 11111111, the lowest bit SEL<0> and the highest bit SEL<1> of the selection signal SEL each become 1. In alternative exemplary embodiments of the present invention, the circuit for generating the selection signal SEL is not limited to the above-mentioned structure and may be variously modified. Further, the circuit for generating the selection signal SEL may be provided inside the signal control unit 602 as shown in FIG. 13 or may be provided outside the signal control unit 602.

The following advantages and/or improvements flow from the exemplary embodiments of a liquid crystal display of the present invention and the driving method thereof described herein. First, a difference in luminance between grayscales is maximized. Second, a response speed of the liquid crystal is improved. Therefore, a display quality of the liquid crystal display is improved in the exemplary embodiments of the present invention described herein.

Although the present invention has been described in connection with the exemplary embodiments of the present invention described herein, it should be understood that the above exemplary embodiments are not limitative, but are illustrative in all aspects, and it will be apparent to those skilled in the art that various modifications and changes may be made thereto without departing from the scope and spirit of the present invention as defined by the following claims.

What is claimed is:

1. A liquid crystal display comprising:

a signal control unit which supplies an n-th image signal;

a voltage supply unit which outputs a first reference voltage when the n-th image signal is not at a highest grayscale level and outputs a second reference voltage having a voltage level higher than that of the first reference voltage when the n-th image signal is at the highest grayscale voltage level;

a grayscale voltage generating unit which receives the first reference voltage or the second reference voltage and generates first to n-th positive-polarity grayscale voltages having positive polarity with respect to a common voltage and first to n-th negative-polarity grayscale voltages having negative polarity with respect to the common voltage; and a data driving unit which receives the n-th image signal, the first to n-th positive-polarity grayscale voltages and the first to n-th negative-polarity grayscale voltages and applies an image data voltage corresponding to the n-th image signal to a pixel.

2. The liquid crystal display of claim 1, wherein voltage levels of the first to n-th positive-polarity grayscale voltages and the first to n-th negative-polarity grayscale voltages sequentially decrease.

3. The liquid crystal display of claim 2, wherein the grayscale voltage generating unit comprises:

an original grayscale voltage generating unit which divides the first reference voltage or the second reference voltage to generate first to n-th original positive-polarity grayscale voltages which have positive polarity with respect to the common voltage and whose voltage levels sequentially decrease, the first original positive-polarity grayscale voltage being lower than the first reference voltage or the second reference voltage and the n-th original positive-polarity grayscale voltage being higher than the common voltage; and a first selecting unit which selects the first reference voltage or the second reference voltage and outputs the selected reference voltage as the first positive-polarity grayscale voltage.

4. The liquid crystal display of claim 3, wherein when the n-th image signal is at the highest grayscale level:

the signal control unit supplies a first selection signal to the voltage supply unit and the grayscale voltage generating unit;

the voltage supply unit is enabled by the first selection signal and outputs the second reference voltage; and the first selecting unit selects the second reference voltage in response to the first selection signal and outputs the second reference voltage as the first positive-polarity grayscale voltage.

5. The liquid crystal display of claim 1, wherein the data driving unit applies the second reference voltage corresponding to the n-th image signal to the pixel when the n-th image signal is at the highest grayscale level.

6. The liquid crystal display of claim 3, wherein:

the grayscale voltage generating unit further comprises a second selecting unit which selects the n-th original positive-polarity grayscale voltage or the common voltage and outputs the selected n-th original positive-polarity grayscale voltage or the selected common voltage as the n-th positive-polarity grayscale voltage; and when the n-th image signal is at the lowest grayscale level;

the signal control unit supplies a second selection signal, and the second selecting unit selects the common voltage in response to the second selection signal and outputs the common voltage as the n-th positive-polarity grayscale voltage.

7. The liquid crystal display of claim 2, wherein the grayscale voltage generating unit comprises:

an original grayscale voltage generating unit which divides the first reference voltage or the second reference voltage to generate first to n-th original negative-polarity grayscale voltages which have negative polarity with respect to the common voltage and whose voltage levels sequentially decrease, the first original negative-polarity grayscale voltage being lower than the common voltage and the n-th original negative-polarity grayscale voltage being higher than a ground voltage; and a first selecting unit which selects the n-th original negative-polarity grayscale voltage or the ground voltage and outputting the selected n-th original negative-polarity grayscale voltage or the selected ground voltage as the n-th negative-polarity grayscale voltage.

8. The liquid crystal display of claim 7, wherein:

when the n-th image signal is at the highest grayscale level;

the signal control unit supplies a first selection signal to the voltage supply unit and the grayscale voltage generating unit;

the voltage supply unit is enabled by the first selection signal and outputs the second reference voltage; and the first selecting unit selects the ground voltage and outputs the ground voltage as the n-th negative-polarity grayscale voltage.

9. The liquid crystal display of claim 8, wherein the data driving unit applies the ground voltage corresponding to the n-th image signal to the pixel when the n-th image signal is at the highest grayscale level.

10. The liquid crystal display of claim 7, wherein:

the grayscale voltage generating unit further comprises a second selecting unit which selects the first original negative-polarity grayscale voltage or the common voltage and outputs the selected first original negative-polarity grayscale voltage or the common voltage as the first negative-polarity grayscale voltage; and when the n-th image signal is at the lowest grayscale level;

the signal control unit supplies a second selection signal, and the second selecting unit selects the common voltage in response to the second selection signal and outputs the common voltage as the first negative-polarity grayscale voltage.

11. The liquid crystal display of claim 1, wherein the voltage supply unit comprises:

a boosting unit which boosts an input voltage provided from the outside and outputs the first reference voltage through a first output node when a first feedback voltage is fed back through a second output node and outputs the second reference voltage through the first output node when a second feedback voltage having a voltage level lower than that of the first feedback voltage is fed back through the second output node; and a feedback voltage generating unit which outputs the first feedback voltage or the second feedback voltage to the second output node, the second feedback voltage being output when the n-th image signal is at the highest grayscale level.

12. The liquid crystal display of claim 11, wherein:

when the n-th image signal is at the highest grayscale level, the signal control unit supplies a selection signal; and the feedback voltage generating unit comprises:

a first resistor connected between the first output node and the second output node;

a second resistor connected between the second node and a ground;

a third resistor having a first end and a second end, the first end connected to the ground; and a switching unit enabled by the selection signal and which electrically connects the second end of the third resistor and the second output node.

13. The liquid crystal display of claim 1, wherein the signal control unit:

compares an (n−1)-th original image signal, an n-th original image signal and an (n+1)-th original image signal which are input for three continuous frames (n−1), n and (n+1);

corrects the n-th original image signal on the basis of a result of the comparison;

and outputs the corrected n-th image signal.

14. The liquid crystal display of claim 13, wherein:

the signal control unit supplies a selection signal when the (n−1)-th original image signal is at the lowest grayscale level and the n-th image signal is at the highest grayscale level, and the voltage supply unit outputs the second reference voltage in response to the selection signal.

15. The liquid crystal display of claim 13, wherein the signal control unit comprises:

a first correcting unit which corrects the n-th original image signal when the grayscale level of the n-th original image signal is higher than the grayscale level of the (n−1)-th original image signal by a first reference value or more and outputs a corrected n-th original image signal having a grayscale level higher than the grayscale level of the n-th original image signal, and correcting the n-th original image signal when the grayscale level of the n-th original image signal is lower than the grayscale level of the (n−1)-th original image signal by a first reference value or more and outputs a corrected n-th original image signal having a grayscale level lower than the grayscale level of the n-th original image signal;

a second correcting unit which corrects the corrected n-th image signal when the grayscale level of the corrected n-th image signal is lower than a second reference value and the grayscale level of the (n+1)-th original image signal is higher than a third reference value and outputs the n-th image signal having a grayscale level higher than the grayscale level of the corrected n-th image signal; and a discriminating unit which receives the (n−1)-th original image signal and the n-th image signal and outputs a selection signal.

16. The liquid crystal display of claim 15, wherein the discriminating unit comprises an NAND operator.

17. The liquid crystal display of claim 15, further comprising:

a first frame memory; and a second frame memory, wherein the first frame memory receives and stores the (n+1)-th original image signal and supplies the n-th original image signal to the first correcting unit and the second frame memory; and the second frame memory receives and stores the n-th original image signal and supplies the (n−1)-th original image signal to the first correcting unit and the discriminating unit.

18. A liquid crystal display comprising:

a signal control unit which supplies an image signal and any one of a first selection signal and a second selection signal, the first selection signal being supplied when the image signal is at a highest grayscale level and the second selection signal being supplied when the image signal is at a lowest grayscale level;

a voltage supply unit which outputs a first reference voltage when the image signal is not at the highest grayscale level and outputs a second reference voltage having a voltage level higher than that of the first reference voltage when the first selection signal is supplied to the voltage supply unit;

a grayscale voltage generating unit which receives the first reference voltage or the second reference voltage and generates first to n-th positive-polarity grayscale voltages which have positive polarity with respect to a common voltage and whose voltage levels sequentially decrease and first to n-th negative-polarity grayscale voltages which have negative polarity with respect to the common voltage and whose voltage levels sequentially decrease; and a data driving unit which receives the first to n-th positive-polarity grayscale voltages and the first to n-th negative-polarity grayscale voltages and applies an image data voltage corresponding to the n-th image signal to a pixel.

19. The liquid crystal display of claim 18, wherein the grayscale voltage generating unit comprises:

an original grayscale voltage generating unit which divides the first reference voltage or the second reference voltage to generate first to n-th original positive-polarity grayscale voltages which have positive polarity with respect to the common voltage and whose voltage levels sequentially decrease and first to n-th original negative-polarity grayscale voltages which have negative polarity with respect to the common voltage and whose voltage levels sequentially decrease, the first original positive-polarity grayscale voltage being lower than the first reference voltage or the second reference voltage and the n-th original positive-polarity grayscale voltage being higher than the common voltage, and the first original negative-polarity grayscale voltage being lower than the common voltage and the n-th original negative-polarity grayscale voltage being higher than a ground voltage;

a first selecting unit which selects the first reference voltage from the first reference voltage and the second reference voltage in response to the first selection signal and outputs the second reference voltage as the first positive-polarity grayscale voltage;

a second selecting unit which selects the ground voltage from the n-th original negative-polarity grayscale voltage and the ground voltage in response to the first selection signal and outputting the ground voltage as the n-th negative-polarity grayscale voltage;

a third selecting unit which selects the common voltage from the n-th original positive-polarity grayscale voltage and the common voltage in response to the second selection signal and outputs the common voltage as the n-th positive-polarity grayscale voltage; and a fourth selecting unit which selects the common voltage from the first original negative-polarity grayscale voltage and the common voltage in response to the second selection signal and outputs the common voltage as the first negative-polarity grayscale voltage.

20. The liquid crystal display of claim 19, wherein the voltage supply unit comprises:

a boosting unit which boosts an input voltage provided from the outside and outputs the first reference voltage through a first output node when a first feedback voltage is fed back through a second output node and outputs the second reference voltage through the first output node when a second feedback voltage having a voltage level lower than that of the first feedback voltage is fed back through the second output node; and a feedback voltage generating unit which outputs the first feedback voltage or the second feedback voltage to the second output node, the second feedback voltage being output when the first selection signal is input to the feedback voltage generating unit.

21. The liquid crystal display of claim 20, wherein the feedback voltage generating unit comprises:

a first resistor connected between the first output node and the second output node;

a second resistor connected between the second output node and a ground;

a third resistor having a first end and a second end, the first end connected to the ground; and a switching unit enabled by the selection signal and which electrically connects the second end of the third resistor and the second output node.

22. A method of driving a liquid crystal display, the method comprising:

supplying an n-th image signal;

outputting a first reference voltage when the n-th image signal is not at a highest grayscale level and outputting a second reference voltage having a voltage level higher than that of the first reference voltage when the n-th image signal is at the highest grayscale voltage level;

receiving the first reference voltage or the second reference voltage and generating first to n-th positive-polarity grayscale voltages having positive polarity with respect to a common voltage and first to n-th negative-polarity grayscale voltages having negative polarity with respect to the common voltage; and receiving the first to n-th positive-polarity grayscale voltages and the first to n-th negative-polarity grayscale voltages and applying an image data voltage corresponding to the n-th image signal to a pixel.

23. The method of claim 22, wherein the voltage levels of the first to n-th positive-polarity grayscale voltages and the first to n-th negative-polarity grayscale voltages sequentially decrease.

24. The method of claim 22, wherein the generating of the first to n-th positive-polarity grayscale voltages and the first to n-th negative-polarity grayscale voltages comprises outputting the second reference voltage as the first positive-polarity grayscale voltage when the n-th image signal is at the highest grayscale level.

25. The method of claim 22, wherein the generating of the first to n-th positive-polarity grayscale voltages and the first to n-th negative-polarity grayscale voltages further comprises outputting the common voltage as the n-th positive-polarity grayscale voltage when the n-th image signal is at the lowest grayscale level.

26. The method of claim 22, wherein the generating of the first to n-th positive-polarity grayscale voltages and the first to n-th negative-polarity grayscale voltages comprises outputting the ground voltage as the n-th negative-polarity grayscale voltage when the n-th image signal is at the highest grayscale level.

27. The method of claim 22, wherein the generating of the first to n-th positive-polarity grayscale voltages and the first to n-th negative-polarity grayscale voltages further comprises outputting the common voltage as the first negative-polarity grayscale voltage when the n-th image signal has the lowest grayscale level.

28. The method of claim 22, wherein the supplying of the n-th image signal comprises comparing an (n−1)-th original image signal, an n-th original image signal and an (n+1)-th original image signal which are input for three continuous frames (n−1), n and (n+1), correcting the n-th original image signal on the basis of the comparison result and outputting the n-th image signal.

29. The method of claim 28, wherein the supplying of the n-th image signal comprises:

correcting the n-th original image signal when the grayscale level of the n-th original image signal is higher than the grayscale level of the (n−1)-th original image signal by a first reference value or more and outputting a corrected n-th original image signal having a grayscale level higher than the grayscale level of the n-th original image signal, and correcting the n-th original image signal when the grayscale level of the n-th original image signal is lower than the grayscale level of the (n−1)-th original image signal by a first reference value or more and outputting a corrected n-th original image signal having a grayscale level lower than the grayscale level of the n-th original image signal; and correcting the corrected n-th image signal when the grayscale level of the corrected n-th image signal is lower than a second reference value and the grayscale level of the (n+1)-th original image signal is higher than a third reference value and outputting the n-th image signal having a grayscale level higher than the grayscale level of the corrected n-th image signal.

30. The method of claim 29, wherein the generating of the first to n-th positive-polarity grayscale voltages and the first to n-th negative-polarity grayscale voltages comprises supplying the second reference voltage or a ground voltage as the first positive-polarity grayscale voltage when the (n−1)-th original image signal is at the lowest grayscale level and the n-th image signal is at the highest grayscale level.

* * * * *